US006282849B1

(12) United States Patent
Tuczek

(10) Patent No.: US 6,282,849 B1
(45) Date of Patent: Sep. 4, 2001

(54) STRUCTURAL SYSTEM

(76) Inventor: Florian Tuczek, Mariannenstrasse 118, D-04315 Leipzip (DE)

( * ) Notice: Subject to any disclaimer, the term of this patent is extended or adjusted under 35 U.S.C. 154(b) by 0 days.

(21) Appl. No.: 09/366,206

(22) Filed: Aug. 4, 1999

(30) Foreign Application Priority Data

Aug. 4, 1998 (DE) ..... 198 35 187

(51) Int. Cl.[7] ..... E04B 7/08

(52) U.S. Cl. ..... 52/81.1; 52/81.4; 52/81.5; 52/79.4; 52/648.1; 52/DIG. 10

(58) Field of Search ..... 52/81.1, 81.4, 52/81.5, 79.4, 648.1, DIG. 10

(56) References Cited

U.S. PATENT DOCUMENTS 3,600,825 8/1971 Pearce .
3,722,153 3/1973 Baer .
4,723,382 2/1988 Lalvani .
5,704,169 * 1/1998 Richter ..... 52/648.1

FOREIGN PATENT DOCUMENTS 90 623 6/1972 (DE) .

* cited by examiner

*Primary Examiner*—Carl D. Friedman
*Assistant Examiner*—Christy M. Syres
(74) *Attorney, Agent, or Firm*—Jones, Tullar & Cooper, P.C.

(57) ABSTRACT

The present invention relates to a building system comprising prefabricated plates for self-supporting space boundaries. To enable simple construction of load-bearing structures that are versatile in three dimensions and that enclose spaces, plates, at least some of which are disposed at different inclinations, in the form of flat, slanted prisms are joined by their side faces directly to one another and/or via bars in the form of long, slanted, square prisms; adjacent connecting faces are congruent, and the square faces of different bars, are disposed parallel or perpendicular to one another.

5 Claims, 15 Drawing Sheets

Fig. 1
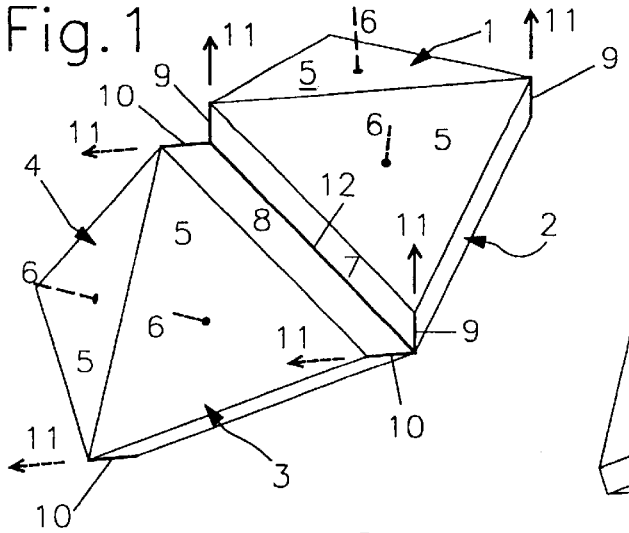
Fig. 2
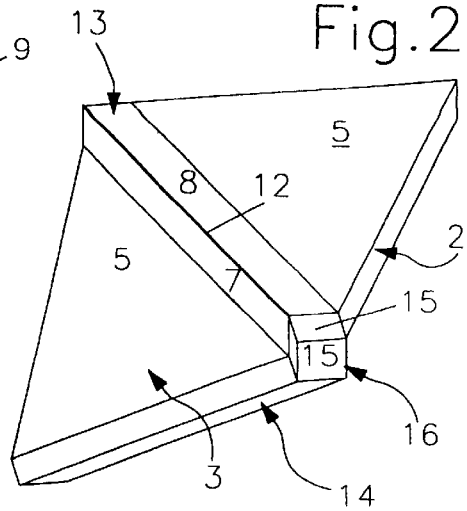
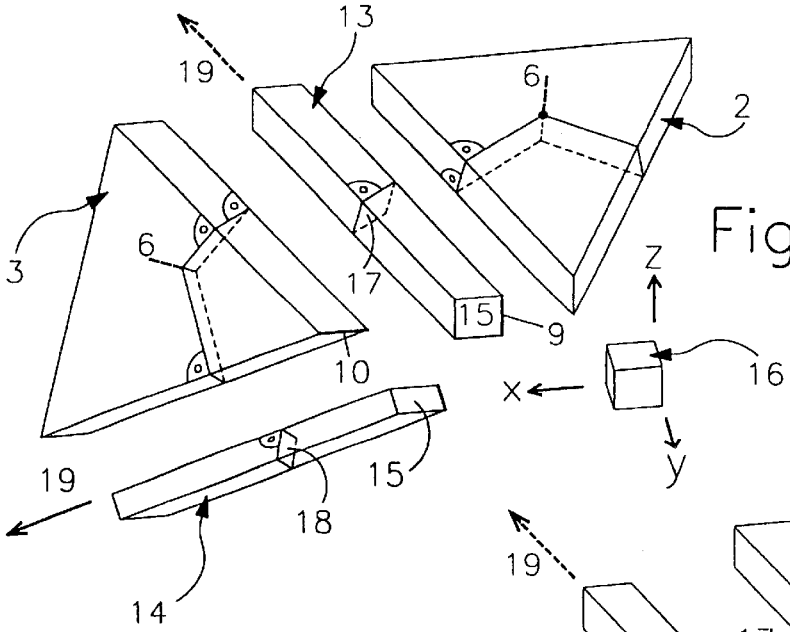
Fig. 3
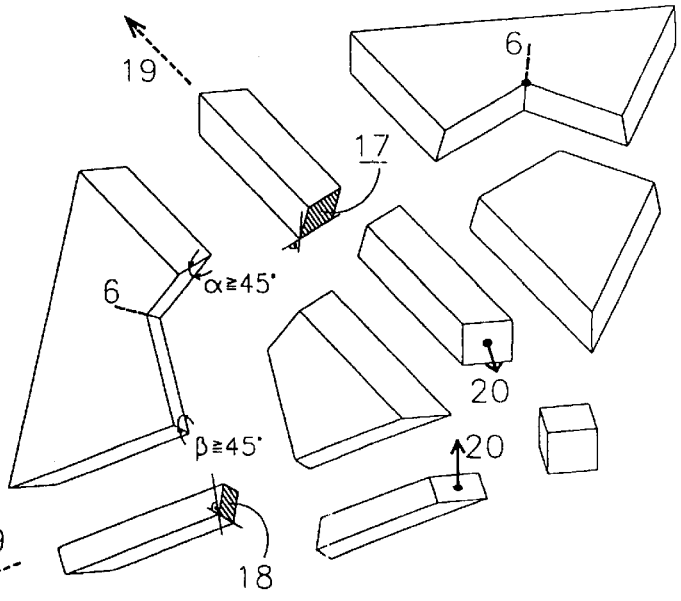
Fig. 4

±x/±y/±z
±x/±y/±z
±x/±y/±z
45°
22.5°
22.5°

Fig. 41
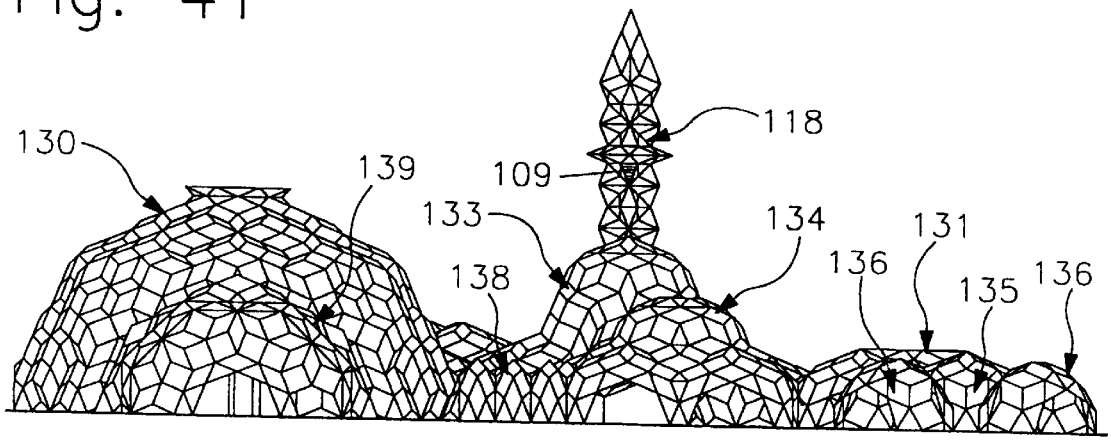
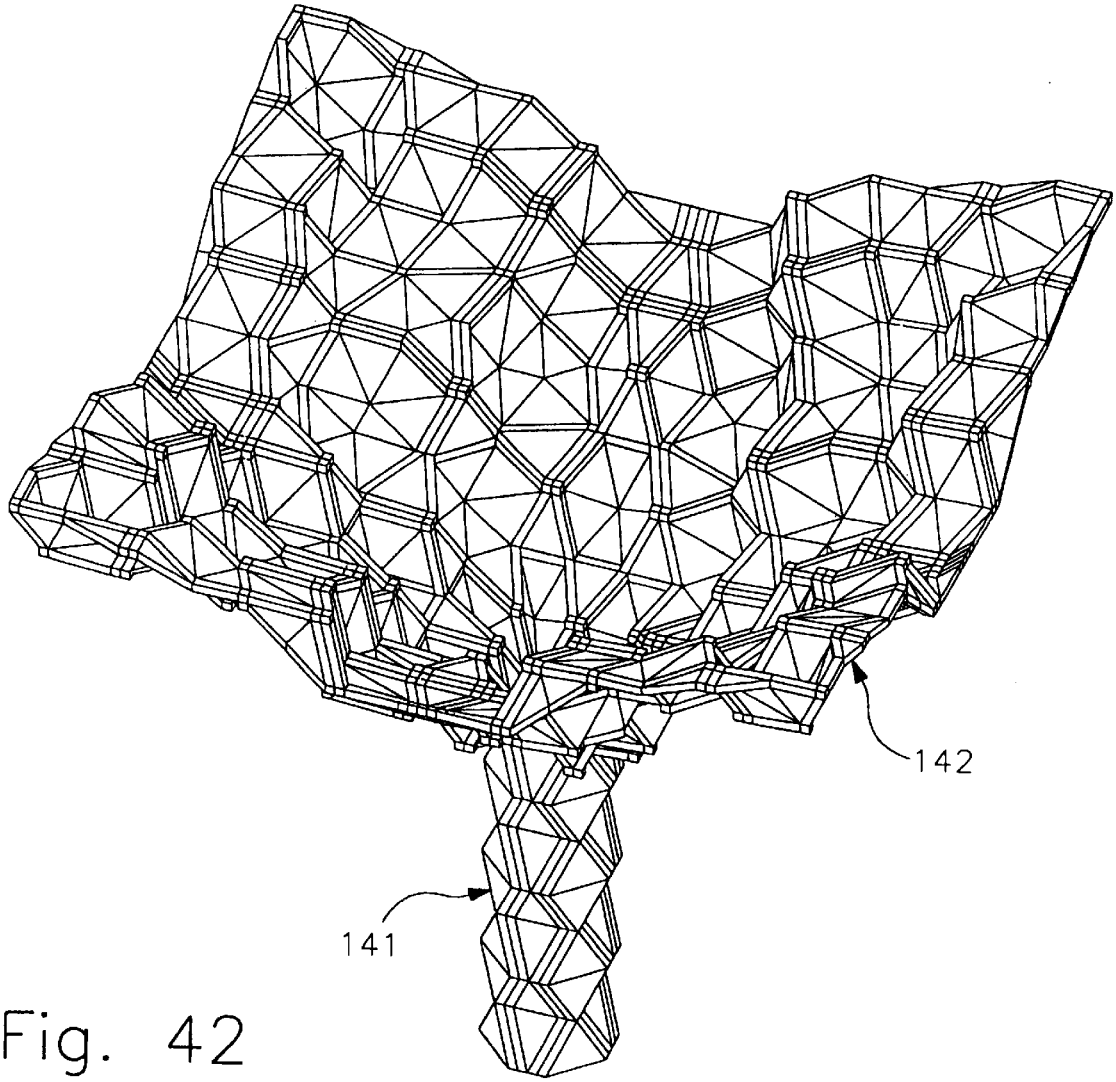
Fig. 42

94
94
100

147
147
148
149
149
146
146
148
98
87
99
145

143
115
115

92
92
114
144
144

148
149
160
150
156
146
156
152
154
87
161
152
147
157
157
155
161
151
147
160
153
154
148
149
159
153
159
163
147
159
158
149
162
99
159
160
148

158
164
164
158
166
165
157
158
157
167
158
166
165
168
168
167

157
112

98
158
157
99
157
157
158
87
113
100
94
91
146
99
146

STRUCTURAL SYSTEM

FIELD OF THE INVENTION

The present invention relates to a structural system comprising prefabricated plates for self-supporting space boundaries.

BACKGROUND OF THE INVENTION

For convexly curved lightweight building constructions, it is known to use the form of zonohedrons (U.S. Pat. No. 3,722,153 to Steve Baer, Mar. 27, 1973). However, the geometry described therein, with its vector star at the pentagonal dodecahedron and at the icosahedron as the fundamental polyhedron, is mostly unsuitable for use in the construction field. Although other vector stars are not expressly excluded, they are not shown, either.

Attempts to embody the constructions, which are called "zomes", in the 3,722,153 patent, in the form of bars in what in a static sense is genuine trusswork, involves monstrous node connections, which previously were surely used only for climbing scaffolds ("The Discovery of Space Frames with Fivefold Symmetry", in the book entitled *Fivefold Symmetry,* edited by Istvan Hargittai, Budapest, 1991, 1992, World Scientific Publishing, Singapore, pages 205 ff).

In the same book, the possibility of creating further geometric structures with an arbitrary vector star is discussed fundamentally by Haresh Lalvani in his article "Continuous Transformations of Non-Periodic Tilings and Space-Fillings", pages 97 ff. In the description in the article of the possible regular location of edge vectors from the center of an imaginary cube through points on a triangular quarter-segment of one side of a cube in FIG. 17, page 115, there is a failure to define a geometric structure that is not merely novel but also readily usable. His construction system (U.S. Pat. No. 4,723,382, Feb. 9, 1998) has only limited utility, and not merely in terms of the geometry of the system lines. The connection proposed therein is suitable for only very thin Until now, connecting shallow, planar elements in three-dimensionally extended load-bearing surfaces has been achieved only with very slight plate thicknesses, which are unfavorable in terms of statics and heat protection. Thicker plates, however, have the disadvantage of becoming undesirably canted against one another. This situation is mentioned by Dave Mielke in his report on constructing a zome (*The Dome Builder's Handbook, edited by John Prenis, Philadelphia, Pa.,* 1973/1985, page 74). Cutting mitered edges where the edges end and meet makes the corners uneven.

The New York artist Tony Robbins also proposes making three-dimensional supporting framework surfaces from plates. These structures are in at least two layers, however, because they must be put together from parallelepiped "cells" in the form of blocklike units which individually comprise six mitered plates of the same lozenge format ("Quasicrystal Architecture", in: IASS Copenhagen, 1991, Vol. 2, pages 45 ff; *Engineering a New Architecture,* New Haven and London, 1996), FIGS. 44, 45 and pages 81 ff).

The "Min-a-Max Building System" (Peter Pearce: *Structure in Nature is a Strategy for Design,* Cambridge, Massachusetts and London, 1978 and 1990, Page 199) was reduced to practice only in the form of a model construction system (U.S. Pat. No. 3,600,825: Synthesized Natural Geometric Structures). With its vector star oriented in the cube, it also makes it possible to produce zomes from packs of rhombic dodecahedra, but its disposition in horizontal projection is in triagonal-hexagonal symmetry, thus resulting in diagonal walls that are unfavorable to use. These are avoided by J. Francois Gabriel—again at the cost of space utilization ("Polyhedra: Skin and Structure" in IASS Working Group No. 15/IL Stuttgart (editors): Application of Structural Morphology, in the Proceedings of the Second International Seminar on Structural Morphology, Stuttgart, 1994).

Geometrically neat connections in three-dimensional trusswork with fillings, similar to traditional wood half-timbering, was already developed over 20 years ago by Walter Kuhn. Its use is restricted, however, to the conventional three-dimensional trusswork structures made up of cubes, tetrahedrons and octahedrons ("Geometrische Gitter und ihre Konkretisierung und Realisierung in Raumfachwerken" [Geometric Lattices and their Reduction to Practice and Realization in Three-Dimensional Trusswork Constructions], in: Second International Conference on Space Structures, organized by Department of Civil Engineering, University of Surrey, Great Britain, 1975).

Thus the use of complex space structures remains actually limited to educational or toy building sets. Examples of this are "Googolplex" made by Arlington-Hews in Vancouver, Canada (Allen W. Banboury, *Investigating polygons and polyhedra with Googolplex,* Vancouver and Philadelphia, 1988), or the "Zometool" made by Biocrystal, Inc. in Boulder, Colorado. (David Booth: "The New Zome Primer", in the aforementioned book edited by I. Hargittai, pages 221 ff).

With regard to the classification and effect of polyhedrons, publications by Helmut Emde (Darmstadt), Peter Pearce (Chatsworth, Calif.) and Ture Wester (Copenhagen) are available.

SUMMARY OF THE INVENTION

The object of the present invention is to solve the problem that until now, three-dimensionally versatile, space-enclosing load-bearing structures could not be constructed in a simple way.

This problem is solved by the provision of a plurality of plates, at least some of which are inclined differently, in the form of flat, slanted prisms joined by their side faces directly to one another and/or via bars in the form of long, slanted, square prisms, and adjacent connecting faces which are congruent, with the square faces of different bars being disposed parallel or perpendicular to one another. Special features of the present invention are disclosed in the claims.

The advantages attained with the present invention are that complex configurations, such as zomes, are not merely through out but in fact constructed, both in free forms for open country, and for existing, confined situations of an urban character, as a compact alternative to cubic structural forms that meets the actual space requirement. The versatility of this system extends even to the static effect, such as that of shells or concertina constructions—even beyond conventional rectangular horizontal projections. Surfaces that span a great distance are stable because of their standing on edge and their concavity—in a way similar to thin plastic plates that are pre-formed by impressing concertina structures of plastically deformable material into them on a small scale, or in the manner of gothic cellular vaulting on a larger scale. In terms of space acoustics as well, the novel structure can be used in a purposeful way.

From the component parts in the present invention, arrangements can be made that are defined exactly and geometrically in detail, as building constructions usually have to be. Nevertheless, overall, it is possible to create free forms that suit the tasks of the building construction, with options for variation. Smooth transitions are just as possible as sharp boundaries. The inventive structure, without constraint to strict uniform or modular subdivision, allows conceptual associations to be made with forms occurring in nature.

Even relatively large constructions, although they may remind one of architectural visions from the periods of expressionism and cubism, which reverberate still today in anthroposophical building constructions, are not architectonic designs. What they are is showpieces, for demonstrating the versatile capabilities of the building system for the planner. The high degree of symmetry in the top view and footprint of the structural arrangements shown makes it possible to view structurally identical or mirror-symmetrical regions from different directions simultaneously. These possibilities can thus be more easily understood in their necessarily three-dimensional view.

The possible applications range from a temporary building, such as a recreational pavilion, and parts of buildings such as the roof of a house, to "vaulted spaces" for convention and exhibition centers that are mounted atop something else or standing alone on the ground. The system can also be considered for use as roofing that is open at the side. For engineering services and technical equipment in buildings, the system is also applicable.

The present invention makes versatile arrangements of plates at slanted angles in space possible, so as to form shells, concertina constructions, cellular structures, or combinations thereof, that have neat joints and a usable minimum thickness in the overall space enclosure, including the edge abutments and corner points.

Building constructions can easily be erected from mass-produced, prismatic components using a reasonably-sized set of component types.

The building constructions can also include regions of rectilinear and perpendicular geometry in horizontal or vertical projection, and they can therefore be combined with existing, conventional building constructions.

The shell-type load-bearing action of a building construction is also reinforced by the system of the present invention in the action of a concertina construction.

Several exemplary embodiments of the present invention are shown in the drawing and will be described in further detail below.

Components of one type, as well as the type itself, are usually identified by the same numeral, unless they are in a completely different context. They are also numbered the same in a more precise elaboration. However, this does not preclude other possibilities of elaboration within the scope of this invention.

Shown in the drawing are:

BRIEF DESCRIPTION OF THE DRAWINGS

FIG. 1, which shows four plates;

FIG. 2, which shows the two plates of FIG. 1, joined via a bar;

FIG. 3, which shows the individual parts of FIG. 2, separated from one another;

FIG. 4, which shows the individual parts of FIG. 3, in each case cut apart;

FIG. 41, which shows the elevation view to FIG. 40;

FIG. 42, which shows a cantilevered tree-shaped roof;

DESCRIPTION OF THE PREFERRED EMBODIMENTS

Figures 5, 6, 7, 8, 9, 10, 11:
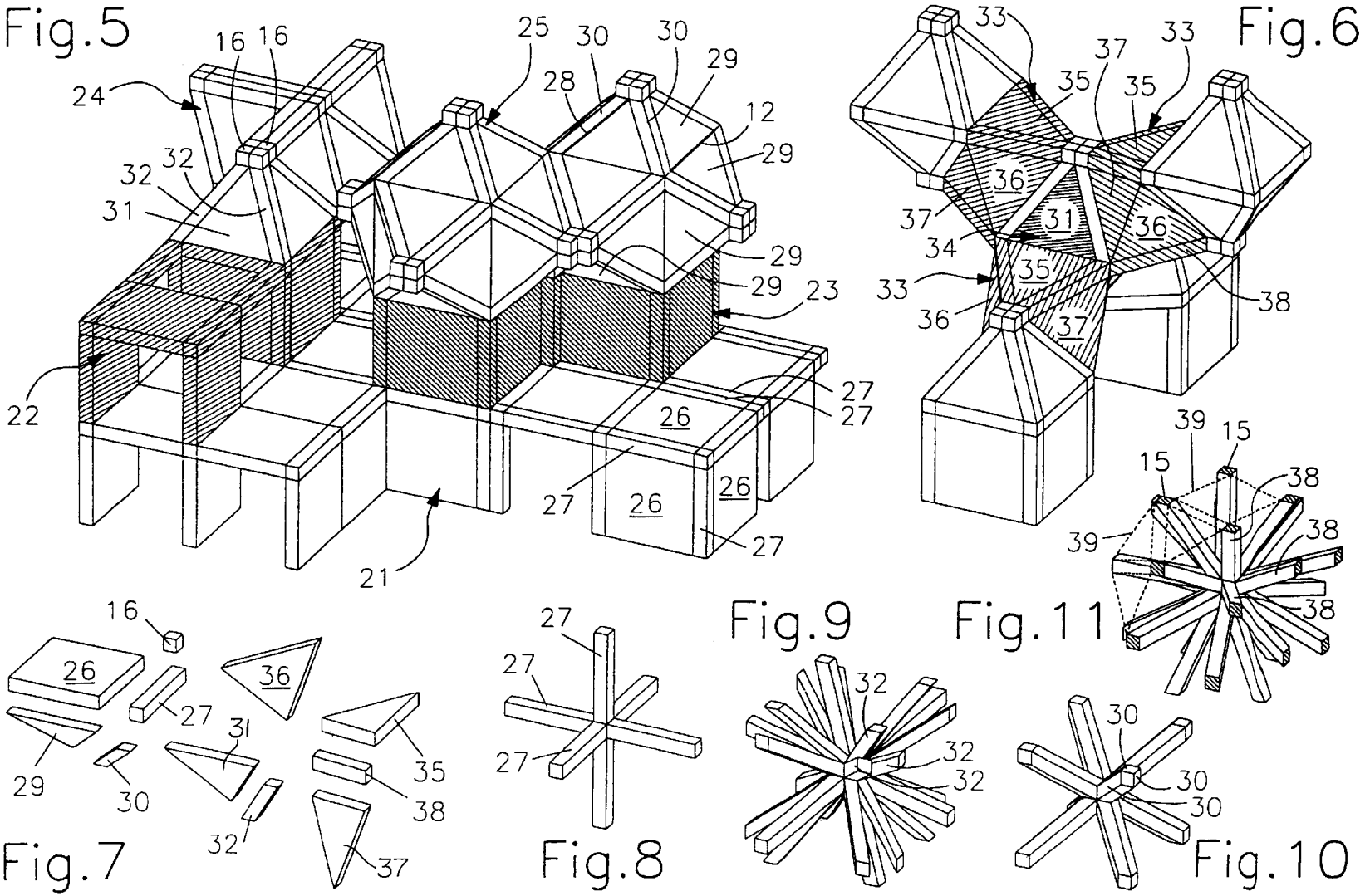
FIG. 5, which shows a building structure made up of cubes, tetrahedrons, octahedrons, and cubic rhombic dodecahedrons.
FIG. 6, which shows a construction having the geometry of cubes, octahedrons and semi-octahedrons.
FIG. 7, which shows the set of component types from FIG. 6.
FIG. 8, which shows the edge star for constructed cubes.
FIG. 9, which shows the edge star for constructed octahedrons.
FIG. 10, which shows the edge star for constructed cubic rhombic dodecahedrons.
FIG. 11, which shows the edge star for constructed octahedrons positioned obliquely.

The novel building system is composed of such structural elements as plates and bars, which will hereinafter simply be called components. A plurality of such components are joined to make large-scale components. The plates are oriented differently and mostly at slanted angles in space. Statically, this has the advantage that from many plates, not only walls but also constructions that span great lengths can be assembled, without being fundamentally restricted by propping means extraneous to the system or to plates that adjoin the envelope surface.

Each plate has its surface oriented differently from those of the adjoining plates. An exception is two adjacent plates when they are perpendicular, or when they can be put together to form a regular quadrilateral or a lozenge, or if they can be laterally held by plates that need not belong to the space boundary.

As a small example of a many-faced large-scale component, four plates (1, 2, 3, 4) are shown in FIG. 1. An orientation of the plane of the surface 5 of one plate in space, which plate is located parallel to the faces between the system lines of the construction, will hereinafter be called the primary orientation, for the sake of simplicity. It is defined by the respective surface normal 6.

In the novel building system, gaps between plates with a different primary orientation need not gape, because their side faces 7, 8 need not, as usual, be vertical to the plate surfaces 5 but instead can be inclined, or in other words can be cut in mitered fashion, specifically in such a way that the plates have the form of a very shallow, slanted prism. Many edge lines 9, 10, which extend spatially outward from the corners of the surfaces 5 of a plurality of plates, are each parallel—in the case of the two upper plates in FIG. 1, they are plumb to the horizontal. An orientation 11 of such equal-length edge lines in one of the three axes of a rectangular reference coordinate system will hereinafter be called the secondary orientation, for the sake of simplicity. The rectangular reference coordinate system, usually aligned with two axes on the footprint of a building construction, will hereinafter be called the coordinate system. Its three axes will hereinafter be called space axes.

The side faces 7, 8 of the plates have the outline of a parallelogram, the ratio of whose sides can be selected within construction engineering limits. Plates with the same secondary orientation and a different primary orientation are logically of different thicknesses, to avert protrusions at the plate joints. Accordingly, if very markedly inclined plates were attached to the upper, relatively shallowly inclined plates 1, 2, then their thickness would be disproportionately slight—theoretically, even near zero. Beyond a certain inclination, the plates therefore have a different secondary orientation at the edges—for the lower plates 3, 4 in FIG. 1, this is a horizontal, approximately parallel location relative to the plane of the drawing.

At the place where the secondary orientation between two plates 2, 3 changes, a bar 13 of quadrilateral profile must be placed at the line of contact 12—as has been done in FIG. 2—in the gap which gapes in cross section, to prevent misfits. In the building surface, its side faces 7, 8 have the same shape as the side faces 7, 8 of the adjacent plates 2, 3. Between two bars 13, 14 with a base 15 oriented differently, the gap that still remains is closed by a cube 16. Since the cube and bar adjoin each other without a misfit, in the same way as the bar and plate do, each bar has equilateral square faces 15 on its ends, as can be seen in FIG. 3. Being elongated, slanted prisms with a equilateral square base 15, the bars have the form of a parallelogram in the profile cross sections 17, 18, which are shown in FIG. 4 not only cut open but also entire.

A lengthwise orientation 19 of a bar in the coordinate system will hereinafter be called the primary orientation for simplicity, and an orientation 20 of the faces 15 on its ends will be called the secondary orientation.

It is recommended that the mitering angle of a plate edge be selected to be no smaller than 45°. Differences in plate thickness, given uniformly thick plate material, can also be simulated by making the plates thinner at the edges by chamfering or milling them, with regular protrusions in the plate surface.

The type of joining that has just been discussed is suitable for any three-dimensional structures comprising many faces. In complex structures made of very many plates, the mass production of prefabricated components is recommended. Here in turn, those structures that are called periodic are simpler, that is, those in which each part, such as a pixel or voxel, occupies fixed places in a matrix or three-dimensional grid.

If they are to be joined together without gaps, the components must have the same lengths on a side. The possible combinations multiply if as many components as possible have the most frequently occurring length, which is associated with the fundamental geometric structure and will hereinafter be called the unit length.

The construction in FIG. 5 is periodically structured in the design of the top view; in elevation, however, there are already different zones that embody related three-dimensional grids: On top of a bottom floor 21 with the height of one plate length and super structures 22, 23 of cube structure, one piece of a pack 24 of tetrahedrons and semi-octahedrons and one piece of a cubic rhombic dodecahedron pack 25 are mounted. The cubic structure comprises completely rectangular plates 26 and bars 27. A three-dimensional pack or crystal lattice structure, which serves as a geometric basis for the system line network of building constructions such as the cubic pack, will hereinafter be called simply geometry.

The rhombic dodecahedron pack 25 is capable of being joined to the cubic structure 23 because the side edges 28, at the first-mentioned more frequently occurring compared with the otherwise uniformly long side-edges 12, are shortened to a certain dimensional ratio. As a result, the isosceles triangular plate element 29 can be put together on its bottom edge 12 not only to an identical element 29 via a bar 27, which is hidden here, of the cubic geometry to form a lozenge, but can also be joined to a square plate 26, while shortened bars 30 adjoin the short plate sides 28.

This is one example of how, by varying a less-frequent bar length of one geometric structure to the unit length of a different geometric structure, manifold combinations of polyhedral structures can be realized, which this invention also encompasses even if they are not expressly described.

Often, however, the common unit length 12 to various related geometries suffices to allow them to be embodied in combined fashion in constructions. This is also the case when the constructed cubic structure 22 is connected to the piece 24 comprising tetrahedrons and semi-octahedrons. This piece comprises three tetrahedrons and two semi-octahedrons, which are put together from parts of one plate type 31 and one bar type 32. The pointed edges of the tetrahedron are realized with double bars. In other arrangements as well, double bars make acute-angled plate joints possible.

The rhombic dodecahedron 25 comprises two adjacent cubic rhombic dodecahedrons, which abut one another with a rhombic face. These polyhedrons, with their rhombic side faces that can be freely combined in space to form closed envelopes, are the smallest regular convex zonohedrons. Even for relatively large zonohedrons, the lozenges can, as here, be assembled from two equilateral triangles in the form of plates—with the same secondary orientation even without a bar located between them.

Where the ends of a plurality of abutting bars 30, 32 are located in the same plane, as at the tips of the semi-octahedrons and the rhombic dodecahedrons, a plurality of corner cubes 16 are necessary, so that the construction can be closed here as well with a continuous minimum thickness.

In the present invention, in contrast to trusswork constructions, three-dimensional corners are not primarily realized in the form of barwork nodes. Primarily, the bars 13 and cubes 16 are filler pieces, which are to be placed next to one another to form bundles or clusters as needed. In contrast to a trusswork node, complicated provisions for junctions that are not even expected to be used are not necessary. A trusswork node must be expected to be large, so that it can handle all the possible connections in different directions that a plate system comprising a relatively small number of types of parts can manage.

In FIG. 5, the bars can be seen as bands in the ceiling of a story; they are located only where construction corners necessitate this. If necessary, the bands can also be doubled or multiplied further. This causes a certain secondary, structurally dictated irregularity in the design of the top view, which is based primarily, in accordance with the system lines, on a square matrix or in other words a regular system.

Each type of plate is intended for at most only one particular location relative to the three space axes; upon its rotation in 90° increments about the X, Y or Z axis, for different primary orientations, this location actually always remains the same, if "X", "Y"and "Z" are arbitrarily exchanged for one another, in each case with a positive and negative sign. But even plates with the same surface format can be located with quite different orientations in space. If for example as in FIG. 6 four octahedrons 33, only three of which are visible, are rotated in such a way that they can act as a connecting element for a central octahedron 34, of which only one plate 31 is visible, and which is located like a carbon atom in the diamond lattice between four identical units, then three further plate types 35, 36, 37 and one further bar type 38 are needed.

One example of each component type for the constructions or structures described above and shown in FIGS. 5 and 6 is shown in FIG. 7 in only one of the possible primary orientations in which it can be used. In all of their possible primary orientations, the plates can be imagined as being placed by two of their side faces between two respective bars of the arrangements in the form of stars in FIGS. 8–11, which in turn represent the various primary orientations of the bars that are possible by rotating them about a center; such an arrangement will hereinafter be called an edge star for the sake of simplicity. Such an edge star, with two parallel bars each, is simpler to understand than an abstract vector star, but it also includes only half of the directions that are possible from a single point outward.

For the sake of simplicity, in FIGS. 8, 9, 10 and 11, for each type of bar its own separate star is shown: The cube pack 21, 22, 23 of FIG. 5 now in FIG. 8 has as its edge star a three-dimensional cross made up of six bars 27. The additional bar type 32 of the tetrahedron-octahedron pack is represented in FIG. 9 in many differently oriented examples, in accordance with the three possible orientations in this case of an octahedron in space.

The rhombic dodecahedrons, in the selected location with regard to the coordinate system, have only one such orientation. However, in their edge star in FIG. 10, three bars 30 are shown in a cluster per "ray": Because of the edge course of under 45° in all three spatial directions of the coordinate system, which course is parallel to that of a cube space diagonal, each edge can be embodied by three bars of the same type 30 with the same primary orientation, but with a different secondary orientation. When an edge of the polyhedron arrangement 25 in FIG. 5 is constructed, however, one bar 30 each suffices.

A more complicated, less symmetrical edge star is formed in FIG. 11 by the bars 38, which are placed between the octahedrons, oriented in fourfold coordination in the coordinate system like the semi-octahedrons in FIG. 5, and the octahedrons 33 of FIG. 6, whose orientation is rotated relative to the former octahedrons; these bars 38 are needed in FIG. 6, in addition to the bars 27 of FIG. 8 that are hidden in FIG. 6. The lesser degree of symmetry can be illustrated if—in comparison among the edge stars—two adjacent bar ends 15 in each case are joined everywhere by dashed lines 39. In the eye of the observer, the result in FIG. 8 is an octahedron, in FIG. 9 a rhombicuboctahedron of altered proportions, and in FIG. 10 a cube, but in FIG. 11 the result is a "snub cuboctahedron", which is a cuboctahedron with rotated squares that is expanded with inserted equilateral triangles.

Regular polyhedrons without fourfold symmetry in vertical plan view, or in general in a projection onto a surface perpendicular to one each of the three space axes, are set up such that a twofold symmetry exists. This is for instance how the three tetrahedrons of FIG. 5, joined together by a semi-octahedron, are oriented.

Figures 12, 13, 14, 15, 16, 17:
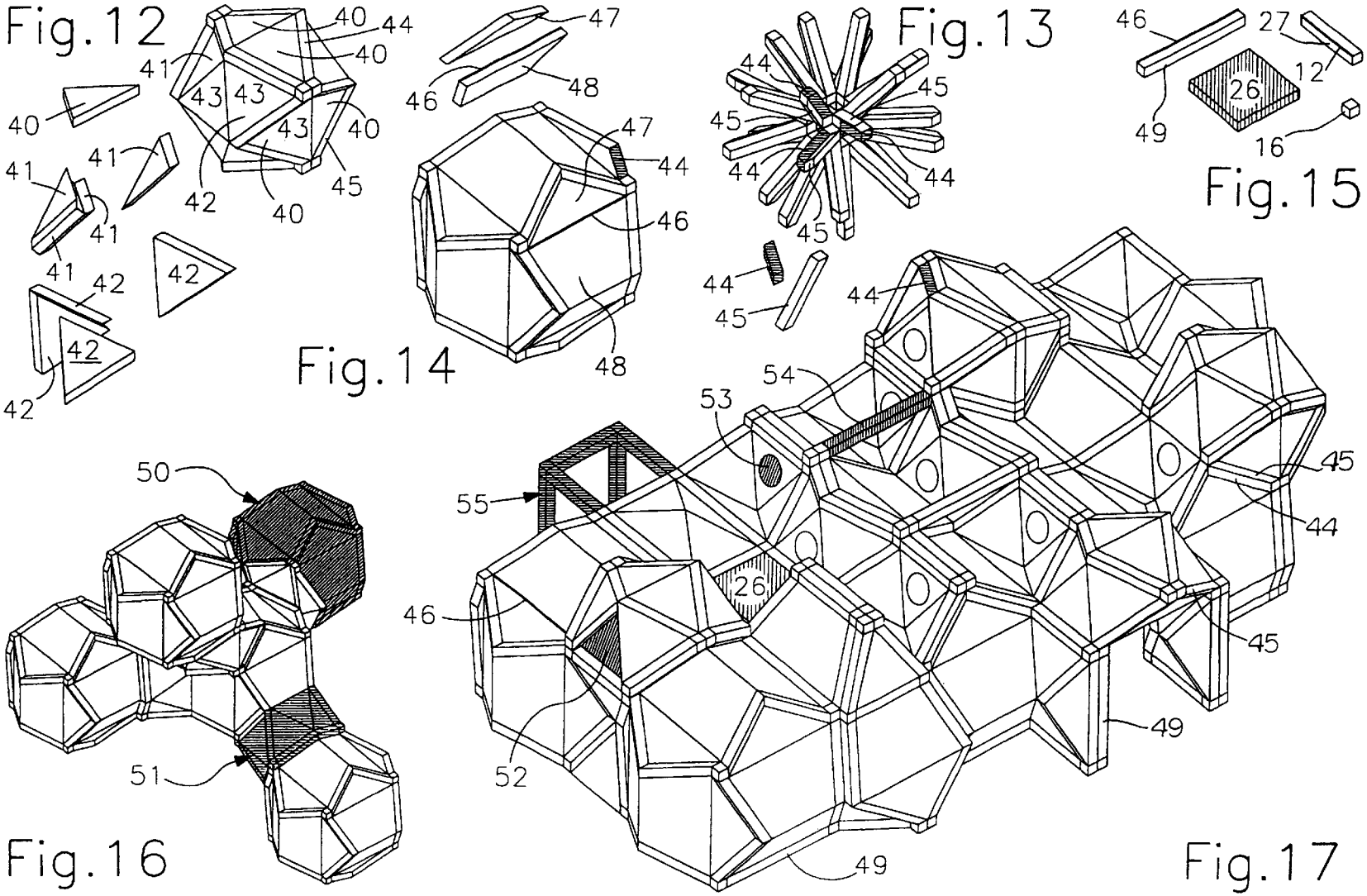
FIG. 12, which shows a constructed icosahedron with its set of plate types, two of them additionally in triplicate.
FIG. 13, which shows two types of bar for FIGS. 16 and 17 and an edge star formed from them.
FIG. 14, which shows a constructed pentagonal dodecahedron with the associated set of plate types.
FIG. 15, which shows the set of cubically oriented component types for FIG. 17.
FIG. 16, which shows a construction comprising five dodecahedrons, joined together by icosahedron portions.
FIG. 17, which shows a shed-roof building made up of dodecahedral and icosahedral pieces.

The same is true for the two individually constructed platonic bodies shown in FIGS. 12 and 13. The constructed icosahedron in FIG. 12 has three additional plate types 40, 41, 42. These do have the same surface format 43 as the faces of the octahedron—that is, an equilateral triangle—and also have the same side length. They differ, however, in their orientation in space. Two plate types 41, 42 in mirror symmetry with one another each have their possible primary orientations parallel to the space diagonals of a cube. In FIG. 12, three examples of each of these two types are shown. These particular primary orientations in fact allow three identical plates to be placed on one another in each case with a different secondary orientation.

For connecting the plates in the icosahedron, two further bar types 44, 45 are needed, one of which, 44, is also used to produce the pentagonal dodecahedron in FIG. 14. Both types of bar have the same primary orientation, and they are therefore each clustered into a "ray" in the edge star of FIG. 13. They differ, however, in their respective secondary orientation. Actually, this edge star should also be shown in triplicate, in order to show all the possible orientations, because dodecahedrons and icosahedrons in their twofold setup—analogously to the semi-octahedron with its star in FIG. 9—can be rotated by 90° without forming the same pattern after the rotation.

The pentagonal side faces of the dodecahedron are divided in two—analogously to the lozenges of the cubic rhombic dodecahedron—by lines 46 that extend in the directions of the space axes. The dodecahedron side faces can thus be realized with one triangular plate type 47, and one trapezoidal plate type 48. To their equal-length, longer side edges 46, overlong bars 49 can also be connected. Like the types 16, 26, 27 of the cubic regions in FIG. 5, their type 49 belongs to the set of rectangular components in FIG. 15, which can be used for FIG. 17.

Clustering different bars 44, 45 in pairs in the edge star in FIG. 13 already suggests the possibility of combining the bodies of FIGS. 12 and 14 of unit length that are dual to one another. These are shown in FIGS. 16 and 17. Thus as shown in FIG. 16, in an arrangement similar to FIG. 6, entire dodecahedrons 50, for which a tight packing is fundamentally impossible, can be joined together in an open pack by means of annular portions 51 of an icosahedron (antiprisms with a pentagonal base). Usable space envelopes can be set up if the dodecahedrons are also broken down further, and the products of thus breaking them down are recombined, as has been done for the shed roof construction in FIG. 17.

This example shows still other facts: Plates can not only be placed on one another in double or triple form but can also be left out entirely, in order to form openings 52; or they can be provided with holes 53 as openings. This has been done here, with identically oriented triangular plates, to provide north-facing skylights in the roof. Furthermore, to further stabilize the freely suspended structure with a manifold surface (concertina shell), isolated short circuits by means of compression or tension bars 54 are possible. If the load is only slight, the bars can also be joined together into scaffolds 55.

The arrangement in FIG. 17 is already structured aperiodically in the system of lines and faces without material thickness and irregularities or offsets in the plate thickness, or in other words cannot be described by a regular axial matrix with fixed system lines. The crystalline structure is coming apart here.

Zonohedrons, such as the rhombic triacontahedron (FIG. 18)—a semiregular convex polyhedron made up of 30 identical lozenges, and the enneacontahedron (FIG. 22)—one of a total of 90 lozenges of two types—are precisely predestined for their use in aperiodic construction structures. Both of them, like the icosahedron and the dodecahedron, lack the capability of being arranged in fourfold symmetry.

The result is a higher number of component types. The set of plate types in FIG. 19 includes among others a plate 56 with a horizontal surface and two plates 57, 58 mirror-symmetrical to one another. However, the advantage of constructions with quasicrystalline configurations of rhombic triacontahedral lozenges, compared with the previously shown and also aperiodic geometry is displayed in the fact that only a single bar type 59 is needed in order to make an edge star comprising many rays of the kind shown in FIG. 20. Here the space in the middle between the ends of the bars is filled with cubes, to make the situation even clearer.

Figure 21:
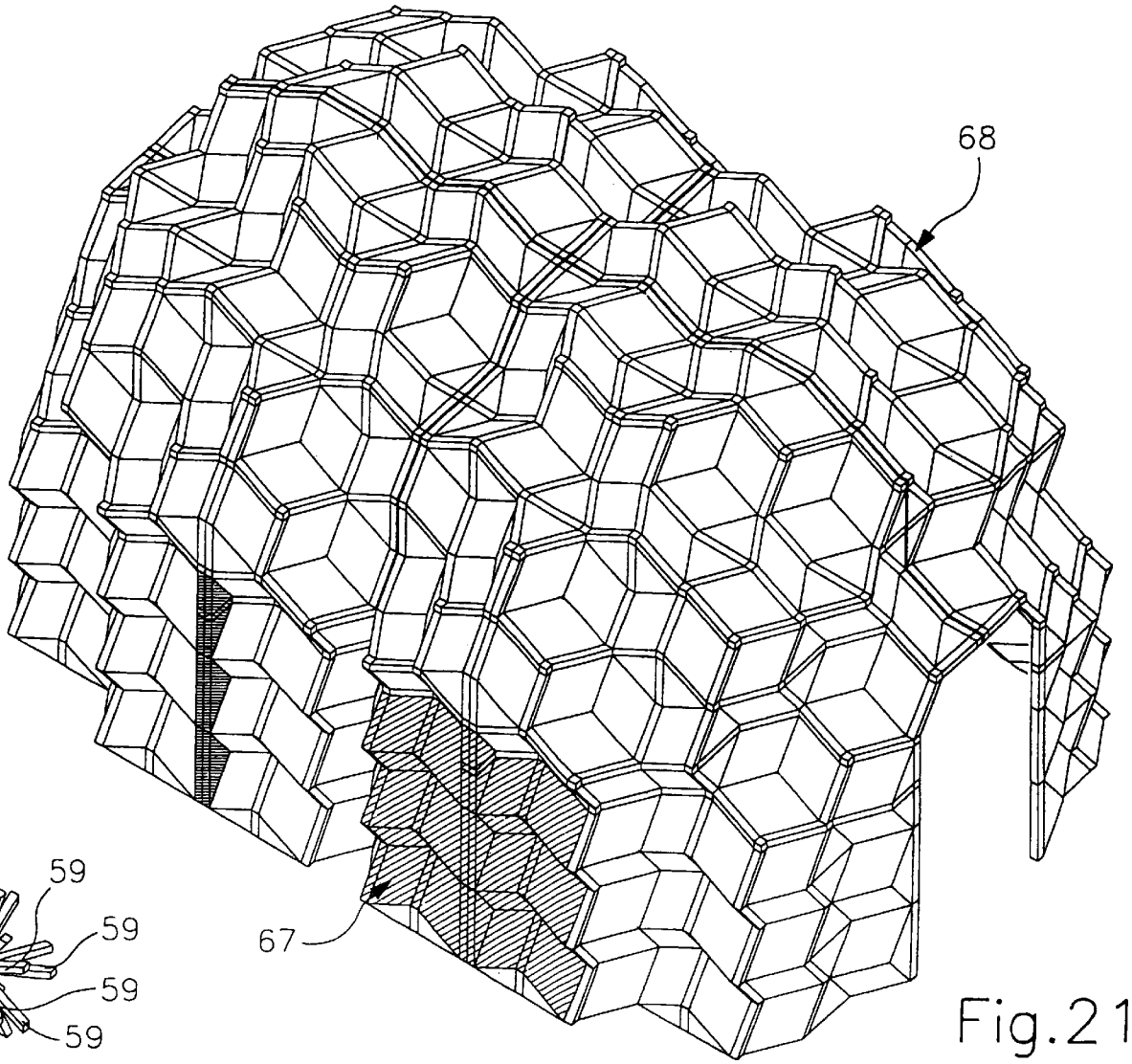
FIG. 21, which shows a construction of a periodically disposed rhombic triacontahedral pieces.
Figure 19:
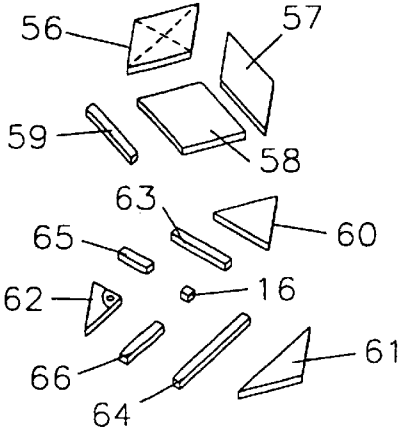
FIG. 19, which shows the set of component types for FIG. 21.
Figure 20:
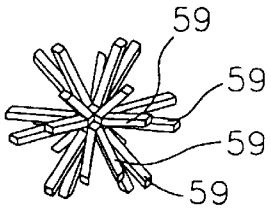
FIG. 20, which shows the edge star for FIG. 18.

By halving and quartering the plate type 56, where here in example 56 is placed horizontally, along the dashed lines, further appropriate component types 60, 61, 62, 63, 64, 65 and 66 in accordance with FIG. 19 are obtained. The plates 60, 61 that have been "halved" take the form of an isosceles triangle, while the "quartered" plates 62 take the form of a right triangle. Half and quartered plates are used as shown in FIG. 21 to form rectilinear terminations at openings, reinforcements (shown with dark shading) and at the base. The bars 63, 64, 65, 66 in the direction of the lozenge diagonals are also used in order to continue the staves in the construction that result from greater "cleavage". Even vertical cuts (heavy lines) through the construction are possible—for instance through the two axes of symmetry of the horizontal projection.

Since rhombic dodecahedrons must be oriented in biaxial symmetry to enable appropriate cuts in planes parallel to at least one space axis, they lend themselves to use in an erected construction which is elongated in horizontal projection. Its walls show periodically structured large-scale components 67 (shown with light shading). At greater length, larger concertina constructions, with regularly zigzagging "spines" similar to the walls, would be unstable without reinforcements perpendicular to the course of the wall (shown shaded dark) and without reinforcing plate faces parallel to them, because they would tend to collapse inward or fall apart outward. Many-faced large-scale components, which can be considered as convexities or concavities, generally hold better than those that can be smoothed out again like a crumpled piece of paper. Within its four different segments differentiated from one another by the aforementioned heavy lines over the two mirror axes of the construction, the convex and concave roof shell 68 in FIG. 21 is constructed aperiodically.

Figure 18:
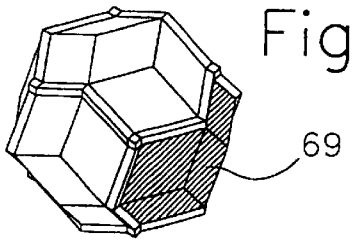
FIG. 18, which shows a constructed rhombic triacontahedron.
Figure 24:
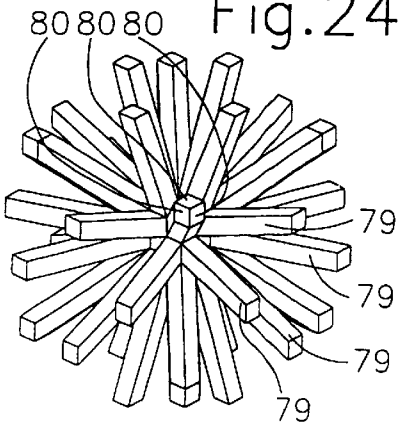
FIG. 24, which shows the edge star for FIG. 22.
Figure 23:
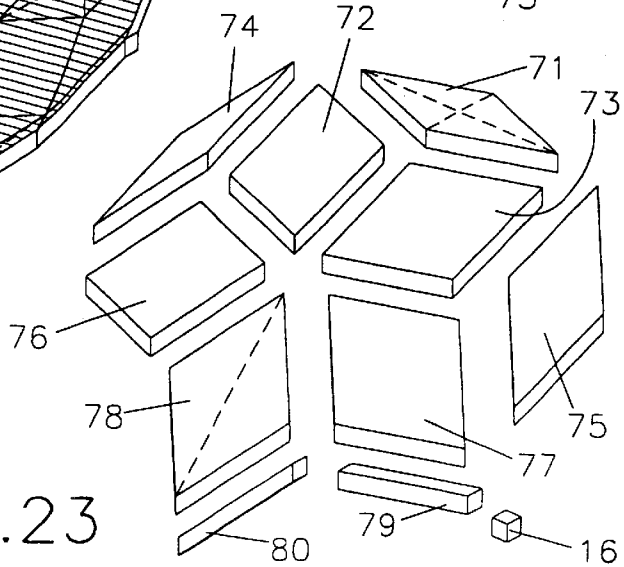
FIG. 23, which shows the set of component types of FIG. 22.
Figure 22:
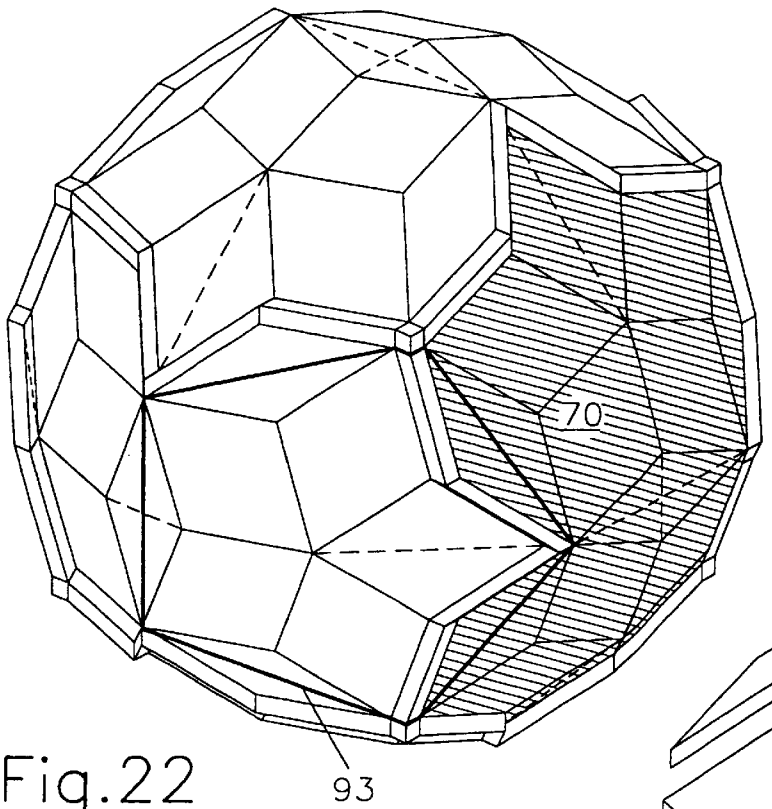
FIG. 22, which shows a constructed enneacontahedron (a polyhedron with 90 faces)

Both the rhombic triacontahedron in FIG. 18 and the enneacontahedron in FIG. 22, with their six cohering faceted surface portions 69, 70 comprising plates with the same secondary orientation, act like inflated cubes, whose polygonal-course edges remind one of the course of the seams in a basketball and are joined with bars. The disadvantage of the large number of plate types 71, 72, 73, 74, 75, 76, 77, 78 in FIG. 23 is lessened by the large number of primary orientations that are thus possible and that are demonstrated by the edge star in FIG. 24, which is made up of bars of only two sorts 79, 80. For reasons of symmetry, the bars 80 are tripled to form a bundle in the direction of the space diagonals of the cubes—analogously to FIG. 10—but with a unit length or in other words without being shortened.

Figure 25:
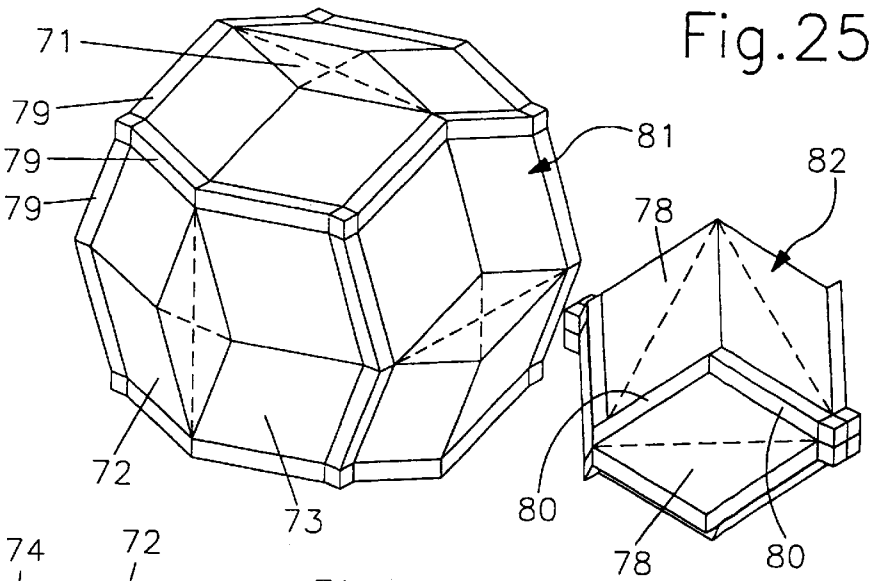
FIG. 25, which shows a distorted rhombic triacontahedron and a rhombic dodecahedron constructed of pieces from FIG. 22.

From the faces of the enneacontahedron, constructions can be made that can be less "cleaved" than those of the rhombic triacontahedron. The possibilities are very numerous, however. In FIG. 25, therefore, only two products of its reduction to structural bodies with only a few faces are shown—first, a rhombic triacontahedron 81 that is distorted in the direction of a cubic shape compared to the shape related to a ball in FIG. 18, and second, a rhombic dodecahedron 82, which in comparison with the same polyhedrons of another construction of FIG. 5 is less symmetrical, but simpler, because it does not need bars 80 at all the edges of the polyhedron, and because its lozenges are not divided by a cleft on the short diagonal, so that bars there are also unnecessary.

Both the enneacontahedron and the rhombic triacontahedron—which from afar look like a sphere—can be cut apart (dashed lines) rectilinearly and cleanly by being cut in half or in four along "great circles" parallel to the planes of the space axes, without other plates being irregularly cut through in the process. As a result—because of the location relative to the coordinate system in twofold symmetry—even systems with pentagonal symmetry, in the form of freely formed aperiodic structures, can be bounded partly rectilinearly at right angles in their outline, to allow vertical termination walls or junctions with cubic, conventional constructions or other, likewise internally aperiodic regions.

However, other proper plane cuts in the enneacontahedron in FIG. 22, that is, those by means of "minor circles" such as that along the heavy line course 93 arranged as a pentagon, are possible only in a single type and size because of the system network lines. In the present transformation with material thicknesses, however, disadvantageous edge misfits occur on a small scale, which, while they do allow the opening to be closed with a straight wall, do not allow a seamless connection to a mirror-symmetrical opening.

Figures 26, 27, 28, 29, 30, 31, 32, 33, 34, 35:
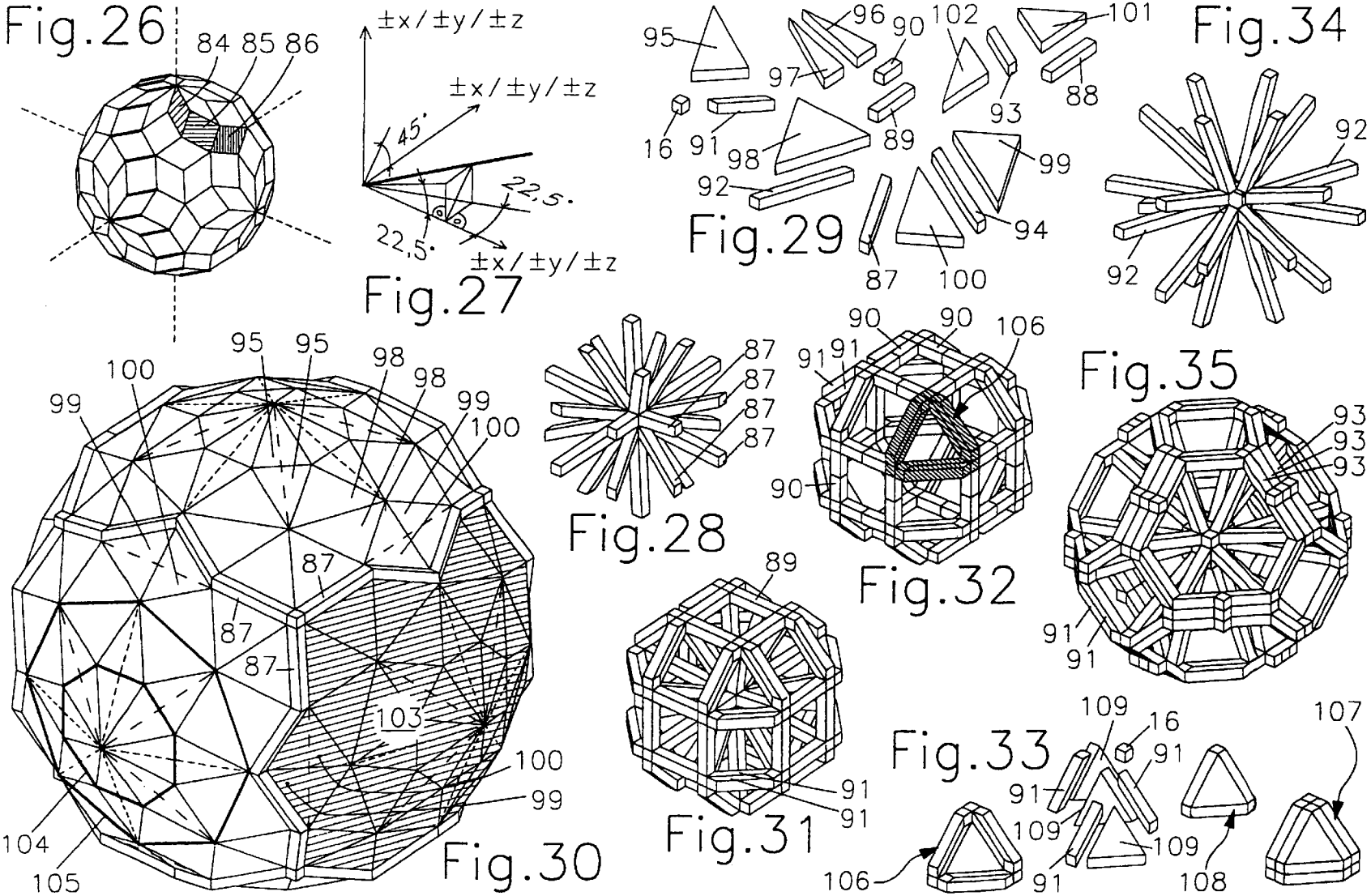
FIG. 26, which shows a novel convex semiregular polyhedron with 132 faces (132-hedron)
FIG. 27, which shows the principle of the edge orientation of the 132-hedron of FIG. 26.
FIG. 28, which shows the edge star for FIG. 30.
FIG. 29, which shows the set of component types for FIGS. 36, 37, 38 and 42.
FIG. 30, which shows a constructed 132-hedron.
FIG. 31, which shows the edge star of FIG. 28, surrounded by a rhombicuboctahedral scaffold.
FIG. 32, which shows the rhombicuboctahedral scaffold of FIG. 31.
FIG. 33, which shows the "web bracing" of a triangular frame from FIG. 32.
FIG. 34, which shows the edge star of the long bar type from FIG. 29.
FIG. 35, which shows the edge star from FIG. 34, in a scaffold in the form of a supported octahedron.

What is therefore better, among other options, is a geometrical structure in which the convex basic polyhedron already offers many rectilinear cutting options, besides those from three "great circles" (dashed lines) and has not only a twofold but also a fourfold, and locally even eightfold symmetry. From its parts, even complex constructions structured identically in both space axes of the horizontal projection—and even those above a square horizontal projection—can also be erected. This polyhedron is the largest semiregular convex polyhedron in zonohedral form shown until now. In FIG. 26, for the sake of familiarization, it is shown as a nonconstructed polyhedral model with system network lines as edges. This polyhedron, called a 132-hedron for simplicity, because of the number of its faces, is made up of lozenges of three types: a very pointed one marked 84, which is also present as a face type in the enneacontahedron, but here is disposed at the six "poles" concentrically with groups of eight; and a nearly square lozenge 85; and finally a lozenge 86 whose proportion is close to that of two equilateral triangles put together.

It is a common feature of all the edges of this polyhedron—as of the parallel edges emphasized by heavy lines to represent them—that as shown for only one of them in FIG. 27, with three projection directions perpendicular to one another, they each have an angle of 22.5° on two of the three projection planes—to a respective projected square axis, and on the third projection plane, they each have an angle of 45° to a respective projected space axis. The 45° angle of this location is the necessary consequence of the equality of the other two angles. In FIG. 27, it is projected in the direction parallel to the space axis shown at the bottom below it. The various combinations of the association of x, y and z, each with a positive or negative sign, for the axis intersection yield twenty-four primary orientations of the bars 87, as can be seen for the edge star in FIG. 28. By including useful halving and quartering of the lozenges of FIG. 26, the result is the set shown in FIG. 29, which comprises component types 87, 88, 89, 90, 91, 92, 93, 94, 95, 96, 97, 98, 99, 100, 101, 102 in FIG. 32 for use in FIG. 42. It can be seen especially clearly from the edge star in FIG. 28, which despite its many rays is formed only of the edges 87 of the constructed 132-hedron in FIG. 30, that a conventional trusswork node with so many junctions would become too thick—especially whenever it would have to hold many other bars as well, such as those necessary because of the halving and quartering of the lozenge faces.

The advantages of the novel construction system, with precisely this novel geometry, are also especially pronounced because this geometry includes the fourfold nature of the cube, which often occurs as a component in the structures according to the invention. The constructed polyhedron in FIG. 30—like the polyhedrons shown earlier in FIGS. 14, 18 and 22—has successions of bars in the arrangement of seams on a basketball—in this case, bars 87 of only a single type from FIG. 28—and the six inflated cube faces 103 that are put together again comprise components with the same secondary orientation.

Figure 54:
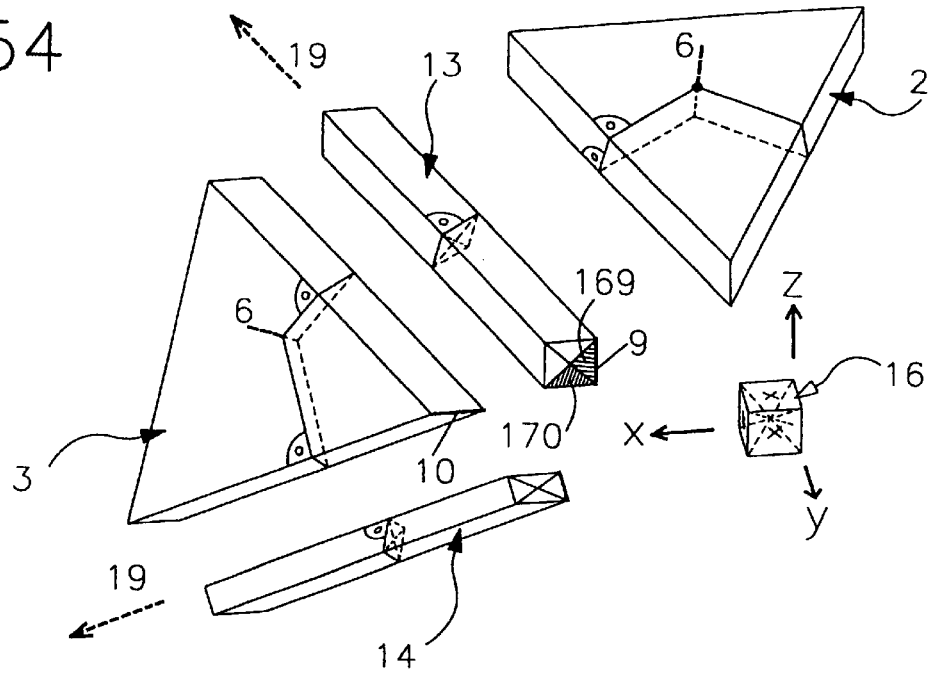
FIG. 54, which shows a view corresponding to FIG. 3 with the bars cut in quarters as shown above.

The possibilities of cutting the new polyhedrons apart in straight lines without destroying components in the same plane are substantially more numerous than in the case of the enneacontahedron. Besides the dashed lines for plane cuts of the polyhedron through "great circles" with orientations along the space axes, FIG. 30 also shows other cuts through "great circles" (dot-dashed lines) on planes with an orientation along the surface diagonal of a cube. However, the overall face that is formed of the notched edges of the plates does not become plane until the bars 87, 88 are diagonally "split" lengthwise in profile. Such "splitting" will also become important in a different context in FIGS. 45 and 54; for now, this will not be addressed further.

There are also more-vertical cuts through minor circles. In top view, they are also perpendicular to one another, or in other words are more symmetrical than with the enneacontahedron. Two such different-sized cuts are shown in FIG. 30, again by heavy line courses 104, 105. Identical cuts horizontally are also possible.

Another advantage of the geometry in accordance with the novel polyhedron is that because of the eightfold nature of the geometry, the component types that embody two of the three rhombic face types 84, 86 not only have a single basic position, but also two different basic positions (locations) to the interchangeable space axes. In other words: more face orientations with fewer types.

Further edge stars are necessary, however, in order to show all the possible edge directions in space that are possible by having and quartering the lozenge faces 84, 85, 86 of the basic polyhedron in FIG. 26. In FIG. 31, the edge star of FIG. 28 has been inserted into the scaffold of a rhombicuboctahedron made up of two types 89, 91 of bars, in order to more clearly show the location of the bars 87, 89, 91 to one another in a proper building construction. A star made up of bars 89 in the cubic arrangement need not be shown; it has already been shown with unshortened unit length in FIG. 8. The octahedral version with this geometry can easily be imagined even without being shown: The octahedron is rotated 45° relative to an octahedron of bars from FIG. 9 that is oriented fourfold in only a single space axis; this means that one further bar type 91 is needed. In this setup—as in the rhombic dodecahedrons of FIG. 5—the same pattern as with a rotation of 90° about the space axes is created in the octahedron as well.

The rhombicuboctahedral scaffold of FIG. 31 is shown slightly modified in FIG. 32 and emptied of its contents. A piece 106 of it, emphasized by shading, is shown on the left of FIG. 33 as an empty frame, which is filled in the structure 107 all the way to the right. How the "infill" 108—shown halfway to the right—is composed of individual components can be seen halfway to the left: It comprises three plates 109, oriented in the cube space diagonal, with the surface shape of an equilateral triangle and a different secondary orientation, as well as three bars 91 and one cube 16. Composite parts, such as this "infill", can also be produced as entirely prefabricated components, from which arrangements can then be composed without additional intermediate bars. Thus eight composite parts 108, like the part 108 shown above, form an octahedron even without an edge scaffold of rods additionally inserted in between. Analogously to the composite triangular plate 108, a square opening inclined by 45°—here not shown separately as an empty frame—can be filled with two square plates of a type other than that of FIG. 5 and not shown, plus one bar 89, if misfits and asymmetries of detail are to be avoided in the construction.

In terms of thickness, a single such square plate would still suffice. This thickness, which all the plates with a primary orientation in the cube face diagonal have, as do the nearly equilateral plates 99, 100 of the eightfold 132-hedron geometry and the plates of the rhombic dodecahedrons 85 and 82 in FIG. 5 and FIG. 25, represents an appropriate minimum for a ratio of the inverse of the square root of two to the thickness of a plate 27 for the cubic arrangement. If this minimum thickness for a space termination with continuous plate load-bearing action is to be kept, then plates with a primary orientation in the cube-diagonal must be at least doubled, because of their necessarily even lesser thickness.

The plate type 109 in FIG. 33 for the "infills" of the rhombicuboctahedral scaffold in FIG. 32 has the same surface shape of an equilateral triangle and the same location in the cube space diagonal, that is, the same primary orientations, as the plate type 42 of the icosahedron in FIG. 12, and it has therefore also the same thickness. The various shapes of the surface and the orientation of their sides on the parallel planes of the plate surfaces in space are different, however.

FIG. 34 shows the edge star of the overlong bar type 92, to which the plates 98 of the halved, nearly square lozenge 85 of the basic polyhedron can be attached. This star is inserted in FIG. 5 into a bar scaffold in the same way as the star in FIG. 31. The scaffold here has the form of a truncated octahedron with two different edge lengths, and in addition to examples 91 of the bar type 91 oriented in the direction of the cube face diagonal, FIG. 2 also comprises examples of a further bar type 93 with the same location, or in other words the same orientation possibilities, but in a different length.

FIGS. 26–35 have shown the eightfold zonohedron structure with arrangements which, while they explain geometric relationships, appear not very useful as a large-scale component or even a building construction. The plate support structures in FIGS. 36–44 that now follow, conversely, have a horizontal footprint.

Figure 36:
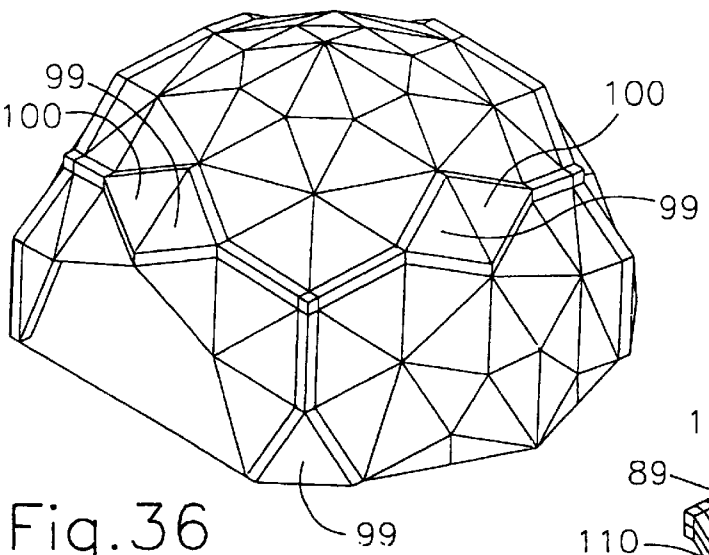
FIG. 36, which shows an igloo in reliance on FIG. 30.
Figure 38:
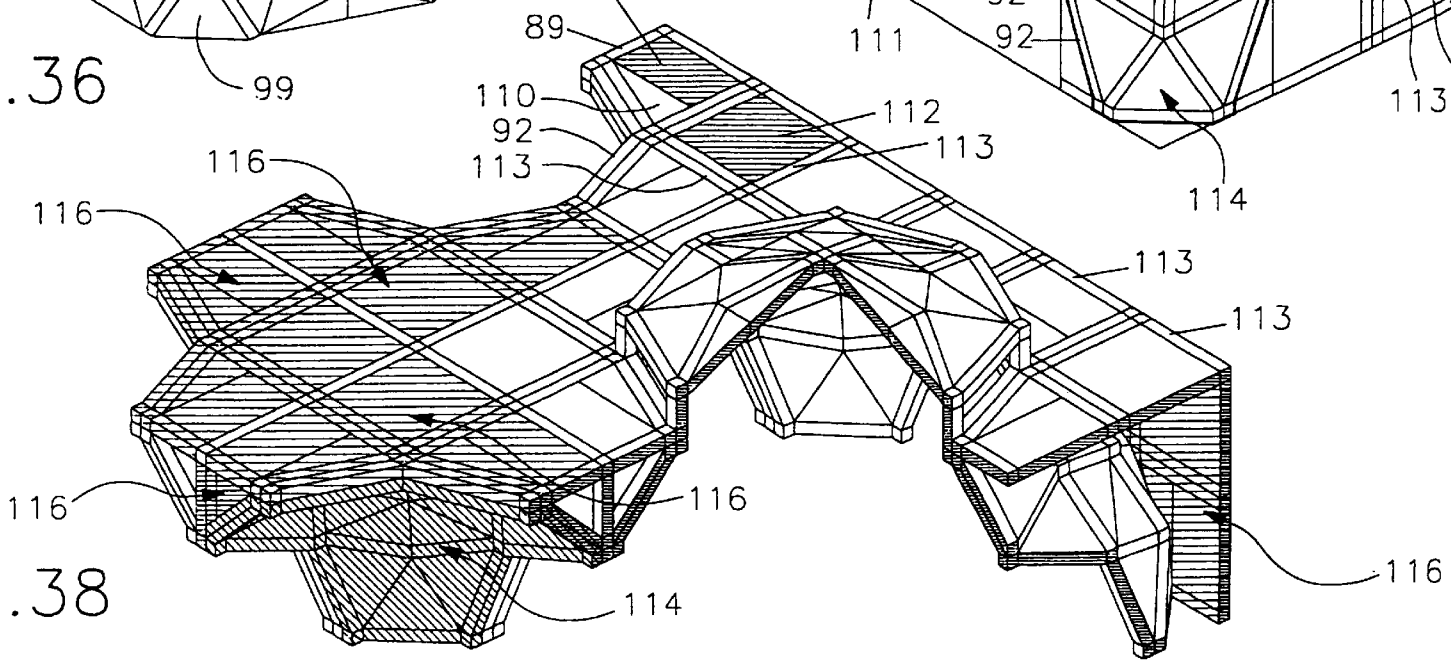
FIG. 38, which shows a different kind of combination of pieces from FIG. 37.

The building construction in the form of an igloo in FIG. 36 represents the upper half of the constructed polyhedron of FIG. 30; cutting off a lateral dome piece along the larger line course 105 of the two heavy line courses, this polyhedron has gained an opening. Furthermore, to increase the outer symmetry, the plates 99, 100 each inclined 45° from a space axis have been doubled. The reason this is possible is that here again the limit situation exists, in which the secondary orientation can tilt back and forth by 90°.

A lateral opening like that of FIG. 36 can be closed again with a wall made up of components 110, 111, 112, 113. However, if it is intended to be suited for attachment to other constructions, then to create the requisite attachment face on the edges of the opening, bars—in this case the overlong bars 92 of FIG. 34—must be mounted, as has also been done in FIG. 37. On the edges of an opening at the top in the roof as well, bars 90, 91 have had to be inserted as an octagonal ring—similarly to what is shown in FIG. 32—in order to create the band-like bearing face for a lantern light. Its bars, with their demand for space, have again burst the structure of FIG. 36 and made gaps, which extend through the entire building construction and are now filled with bars of multiple types.

In other constructions as well, right- or acute-angled outer and inner corners as well as obtuse-angled corners, in a change of secondary orientation, create bands that extend through the entire construction. By skillful definition of the course of each band through as many as possible inner and outer corners, which are present anyway, the number of such bands can be kept low.

Figure 37:
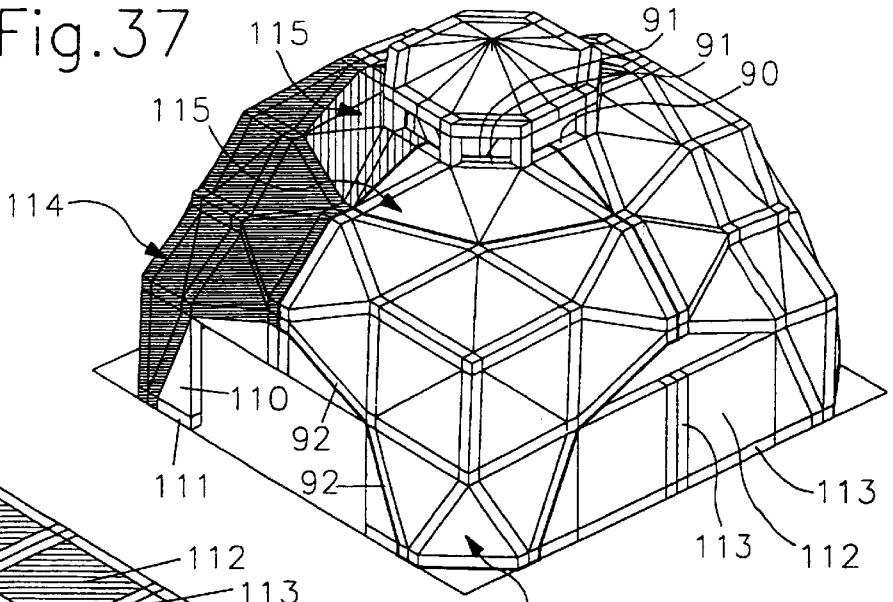
FIG. 37, which shows a house, as a modular unit.

The building construction in FIG. 37 can be assembled (without the walls and lantern) from four prefabricated large-scale components 114—called corner shells for simplicity—and four prefabricated smaller large-scale components 115—called cupola quarter rings for simplicity.

In still another way, the corner shells 114 can be used for a modular construction, which is shown in cut form (cut line indicated by heavy shading): Four corner shells are braced against one another on the floor—as seen in part on the left of the drawing. Together with four large, vertical slabs 116 (two of which are partly visible) comprising parts 92, 110, 112, 113 of the wall terminations of FIG. 37, the completely rectangular bars 89 of FIG. 31, and rectangular plates of a new type 117, they support four identical slabs 116 in a horizontal location (three of them are indicated by coarse shading); these slabs are joined together via further bars 113 to form a flat-roof ceiling, which is thus supported from below at nearly every corner of a plate, and as a result major bending stresses at the edge joints are averted. The roof ceiling reinforces and at the same time holds the upper edges of the corner shells 114 that pull laterally against one another at the top. Thus modular building construction units form, which can stand on their own if they are firmly anchored in the soil but also stand firm when mounted against one another. In a grouping of such modules, large octagonal holes remain free in the roof and can be spanned with superstructures, such as a large lantern as shown here.

Figure 39:
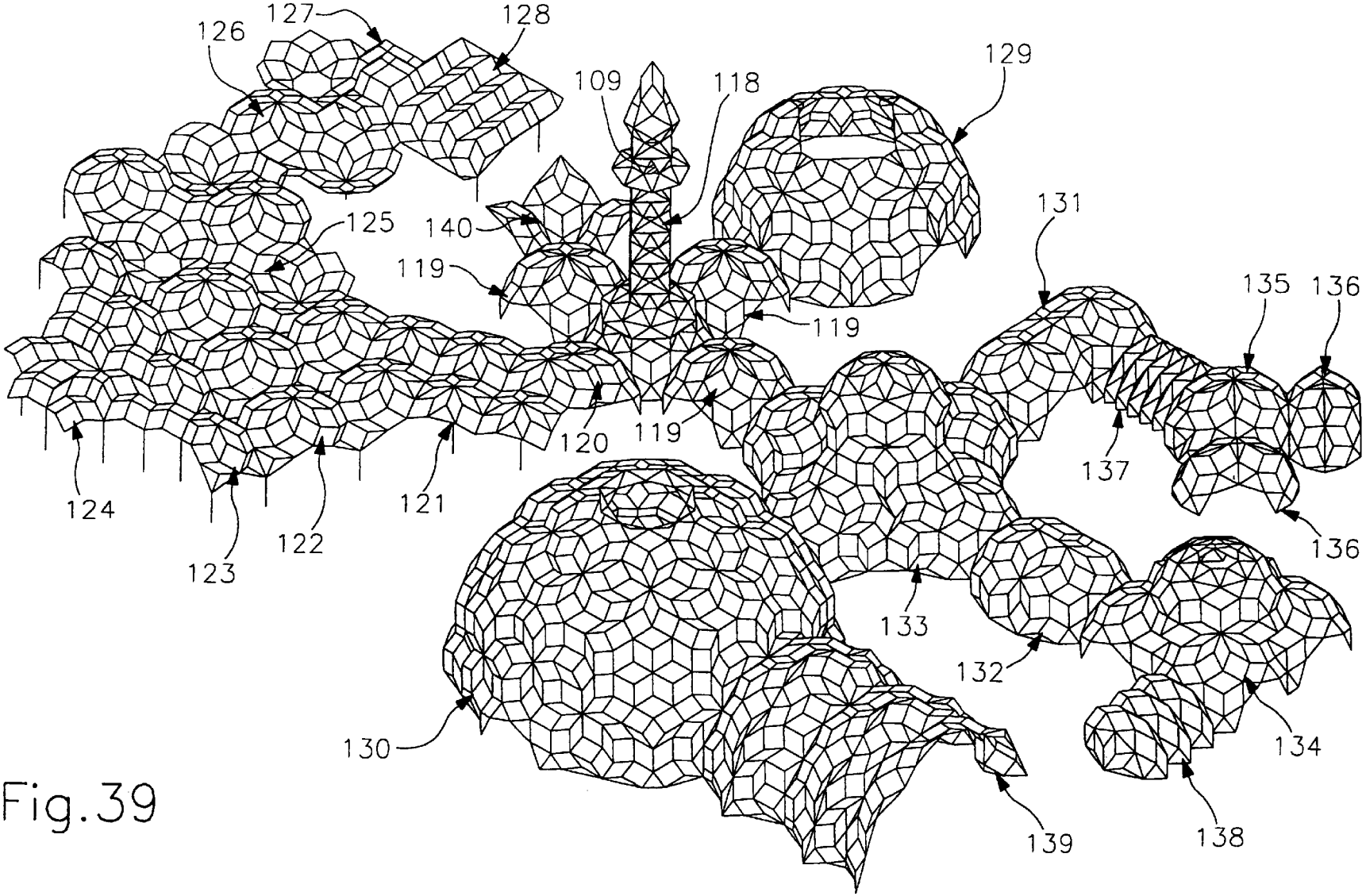
FIG. 39, which shows a construction of components from FIGS. 29 and 33, without showing the plate thickness.
Figure 40:
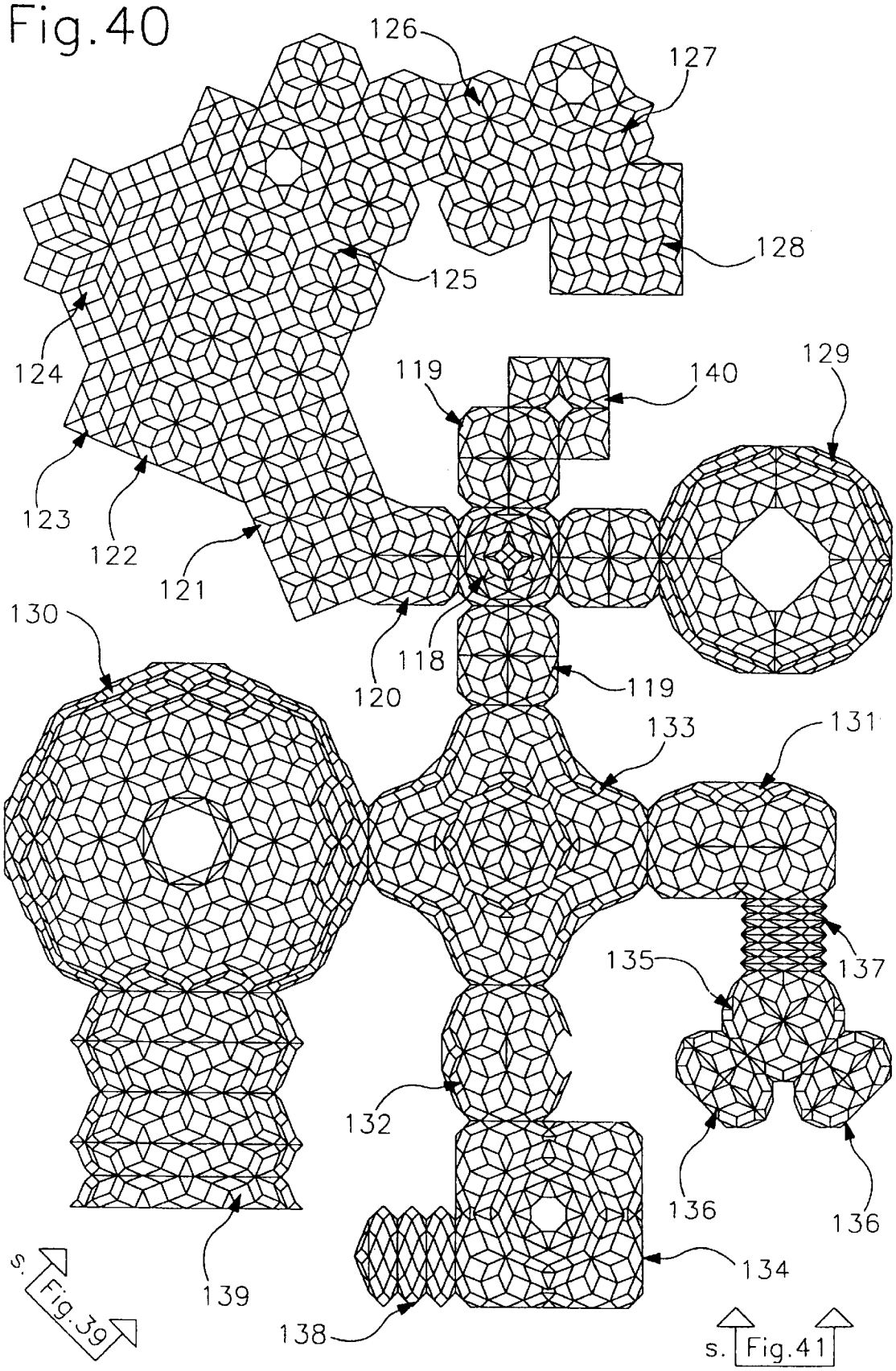
FIG. 40, which shows the top view on the exhibition building of FIG. 39.

A superstructure in the form of a tower 118 on four corner shells 114 put together in a cupola form is driven onto the peak in the middle of the complex structure in FIGS. 39–41, which because of its complexity is shown only as a polyhedral model without indicating the material thickness. The shaft of the tower contains the otherwise unused triangular element 108 of FIG. 33.

Around its base of corner shells, modules 119 are disposed on three sides in the manner of FIG. 37; here, they are inserted as transitions to regions of various shaping. The fourth side—in the left upper quarter of FIG. 39—is adjoined—via a freely shaped construction structure 120 as a transition to umbrella modules 121—by round and upset shallow cupolas 122 and 123, respectively, which are inseparably connected to a concentric free form 124. The shallow cupolas 121, 122 merge with a roof 125 made up of overlapping waves, which resolves into an irregular region 126 that leads, in an aperiodic portion 127, to a regularly structured supporting construction 128 on an inclined (imaginary) plane carrier surface, which is curved on its lower edge, as a laterally open end of the succession of regions.

In the other directions from the tower 118, cupola modules are attached to one another; they have periodic and aperiodic inner structures 129, 130 or in turn appear to have been created from two smaller cupolas 131, 132 or more than two smaller cupolas 133, 134 that have blended together to varying degrees.

A small cupola open on four sides, in size on the order of half of a 132-hedron, can also be reshaped in such that as at 135, it only has three lateral openings, or at 136 appears to be upset in one direction. Various modules can be joined via barrel—vaults 137, 138 in concertina like arrangement. Barrel—vaults 139 can also be very large and can have caesuras, which even on a large scale act statically like a concertina structure. Freely cantilevered structures 140—here without additional wall and ceiling slabs 116 as in FIG. 39—are possible, given increased edge stiffness and material thickness. The top view in FIG. 40 of the stretched-out exhibition construction of FIG. 39 shows how simple and rectilinear the outlines and openings of individual regions can be.

Figures 43, 44:
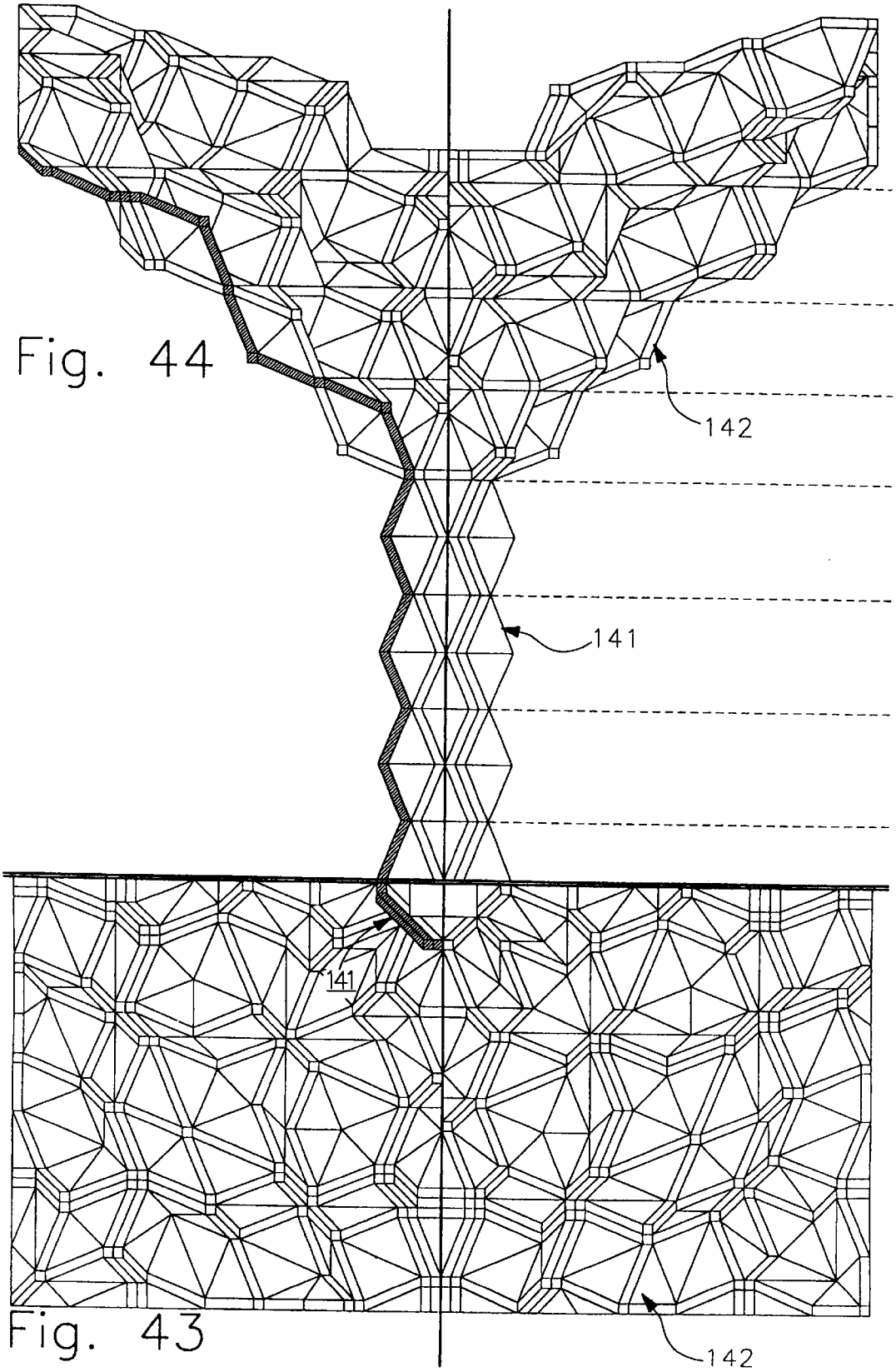
FIG. 43, which shows the bottom view and top view for FIG. 42, each showing one-quarter.
FIG. 44, which shows the section and elevation view for FIG. 42, each showing one-half.

The contrast between the simplicity of the outlines in rectangular projection and the versatility of the three-dimensional inner structure is even greater in the following example, which is shown in FIGS. 42–44. With it, the greatly stretched-out and branching layout of the exhibition construction, made up of relatively simple partial regions, is followed by a building construction that looks like a tree when seen from the side, with a highly dispersed inner structure, which has the simple outline of a square in a top view design, and it can therefore easily, when multiplied, be put together to form the roof of a vaulted waiting area. In its side view in FIG. 44, despite the zigzag inner structure, plate joints show as straight altitude lines, which continue as dashed lines in the drawing. Above a hollow support post 141, which is anchored rigidly in the soil and is especially stable because of kinks, acute-angled inner corners are present between each two plates at the "branching point", from which the three-dimensionally curved roof face 142 develops, and these inner corners can each be managed via two bars, as in the tetrahedrons of FIG. 5.

The high degree of symmetry of the eightfold geometry is also exhibited in detail: The bar profiles, for instance, do not have the profile cross section of merely some sort of parallelogram as in its fivefold geometry, but instead specially have the profile cross section of a lozenge or a rectangle.

The connection of the components to one another in accordance with claim 1 is possible in the most various ways. The component joints can enclose hollow spaces for connection options. However, special seam zones can also be provided, whose surface with their side is oriented in a respective space axis like a visible side face of a built-in bar, and these zones contain connecting elements, casting compositions, mortar, or paste-like adhesive.

It is a precondition of the possible version described below of the connection of the components that the components are clamped in press-fit fashion together yet can still be disassembled. Windproofing can be attained by means of seals in grooves on the side faces of bars and plates. Rainproofing can be achieved by additional layers of canted and flat-folded sheet metal, liquid plastic, or other materials, which are either thin or which with their own zones continue the disposition shown in refined form in terms of layer thickness for the outer and inner corners. The top and bottom sides of the plates are of the same quality, as in the previous illustrations, so as to keep the number of types low.

Figures 45, 46, 47, 48:
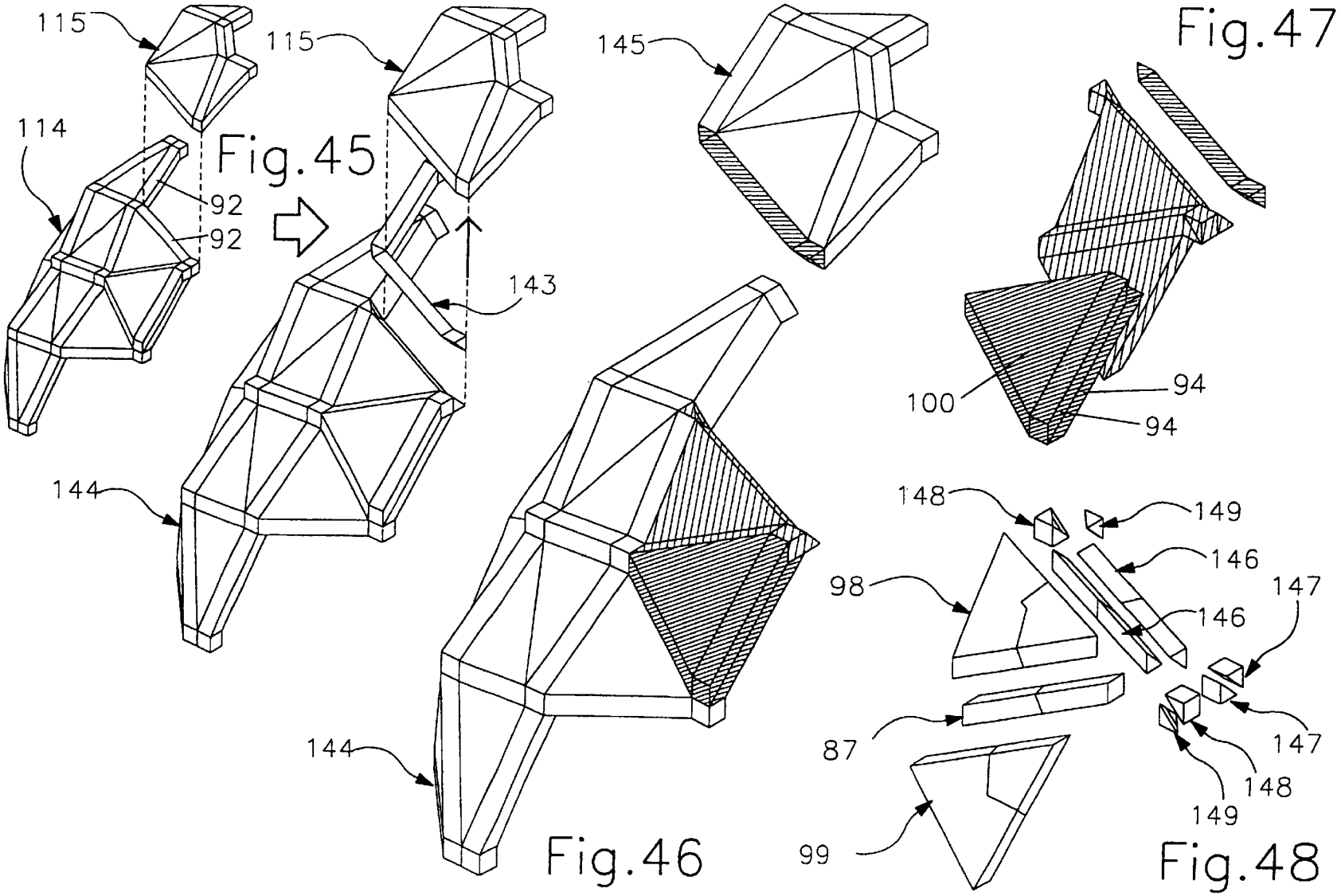
FIG. 45, which shows the modification of the edges of two fragments from FIG. 37.
FIG. 46, which shows the outcome of the modification in FIG. 45.
FIG. 47, which shows some fragments from FIG. 46.
FIG. 48, which shows the individual components from FIG. 47, as an overview for FIG. 49.

To make a clear description of the exact and robust connections that can be undone again, recourse has been had in FIG. 45 to two large-scale components, namely a corner shell 114 and a cupola quarter ring 115, from the arrangement in FIG. 37. The adjacent edges of these two pieces are to be altered such that a cupola, which can contain four joined-together cupola quarter rings 115, can easily be removed for repair or replacement from the large octagonal hole between four joined-together corner shells 114. Therefore in FIG. 45, a small piece 143 is severed from a corner shell 114 and attached to a cupola quarter ring 150. This creates a reduced-size lower large-scale component 144 and an increased-size upper large-scale component 145. For this purpose, as already noted in another context, bars that are divided lengthwise in the diagonal of their profile cross section must be provided. In the present case, the bars 92 contacting the edge have been "split" lengthwise.

Some components in FIG. 46 will now be described in further detail. For the most part, they have already been selected in FIG. 47. However, a doubled plate 100 and two parallel bars 94 are now also removed, in order to arrive at the final selection of parts. These parts are already shown separate in FIG. 48, so that the side faces of the components can be seen freely; these components can be seen larger in FIG. 49.

These are two plates 98, 99, one bar 87 of lozenge profile, two half bars 146 of triangular profile, which together can replace one entire bar 92 of rectangular profile, as well as two structurally identical half cubes 147, which can be imagined as being created by having divided a cube along two parallel face diagonals, and finally, two times two cube pieces 148, 149, which are again complimentary to one another but different. The two non-identical pieces can be imagined as being created by cutting apart a cube in a plane that is normal to its space diagonal and through three of its corner points. "Cut-apart" cubes are necessary, in bands made up of "split" bars.

Depending on the size relationships, the components can be more markedly or less markedly, to save material, divided, subdivided, or even, while preserving essential association options, deformed; which is dispensed within the following example of thin plate material such as plywood and an edge reinforcement of quadratically profiled timber with metal fittings. In the imagined order of magnitude of a plate approximately two meters on a side (shown upset in the drawing), a mode of construction using a homogenous material (wood cement, porous concrete, foamed materials), molded parts (plastic, wood composition), canted metal sheets, or composite panels would be conceivable in accordance with the invention.

Figures 49, 50:
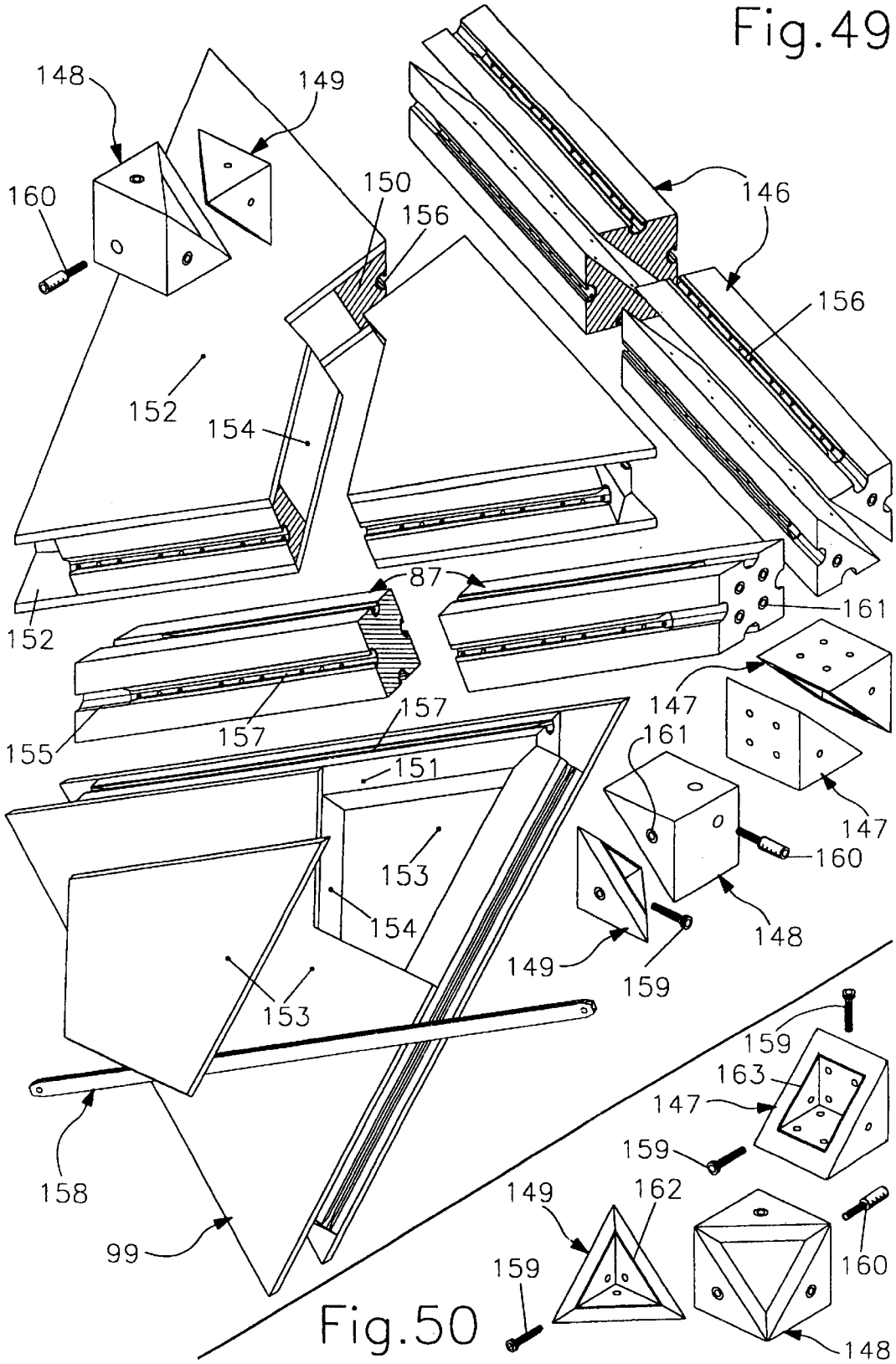
FIG. 49, which shows several components with devices for joining them together.
FIG. 50, which shows the cube elements for corner connection in accordance with FIG. 49, seen from a different direction.

For the view of FIG. 49, the components are shown cut apart. The cutting lines have already been shown beforehand in FIG. 48. One plate component 98 has been sawn through completely; another plate component 99 is partly open at the top. Each comprises an edge, reinforced all the way around, made up of quadrilateral profiles 150, 151, between two layers 152, 153 of rigid plate material. The hollow space between contains an insulation 154. Grooves 155 are milled into the free sides of the plate frames 150, 151 and into the side faces of the bars, and C-rails 156, 157 are let into these grooves. On the sides of unit length, the rails 157 are always of equal length.

A connection between two components is made by joining two C-rails, each being part of a component, to one another by means of an H-rail 158 thrust into both C-rails. The C-rails are shorter, by a constant amount, than the side lengths of the respective component. The reasons for this are as follows: The C-rails need not be shortened at slanted angles and to different lengths. The H-rails can be introduced more easily between two bars. In plates, compared with bars, more working room has to be kept free for introducing the H-rail, because an already mounted plate with a bulky corner can occupy the space needed for mounting other plates. Because there is more working room, the corner regions of the plate edge are given a simpler form for the sake of production from edged timbers.

From the direction of their particular indentations, the cube pieces 147, 148, 149 are screwed to the bar ends with screws 159, 160. The screw holes in the bar ends comprise elongated nuts 161 glued in place. The indentations in the oblique cubic piece faces create the rectangular bearing faces and the space for the screw head together with working room. If the cubes, as shown up to now, serve only as a filler piece, then the connections are not subjected to any major load. For construction constructions that include barwork regions, however, metal reinforcements 162, 163, as seen in FIG. 50, and relatively strong materials for the actual components, are necessary. The largest piece 148 of a cube, intended for filling and supplementing, is secured with special screws 160. Because they are sunk deep in the screw hole, so that other screw holes intersecting the hole remain free, they have extra-long heads. The screw end can thus be passed cleanly to the internal thread of the elongated nut 161 glued into the rear end of the screw hole.

Like two half cubes, unequal cube pieces 148, 149 can also be used together as a filler piece. In the case of the smaller piece 149, in the form of an upset tetrahedron, the indentation is raised like a crater from its large, equilateral face. An indentation on the complimentary element 148 fits this raised area with a hollow space. This makes the small piece larger and more stable, as does the fact that component edges with acute angles are avoided. Thus reinforced, the small cube pieces 149 can also be used to form small bar constructions.

Figures 51, 52, 53:
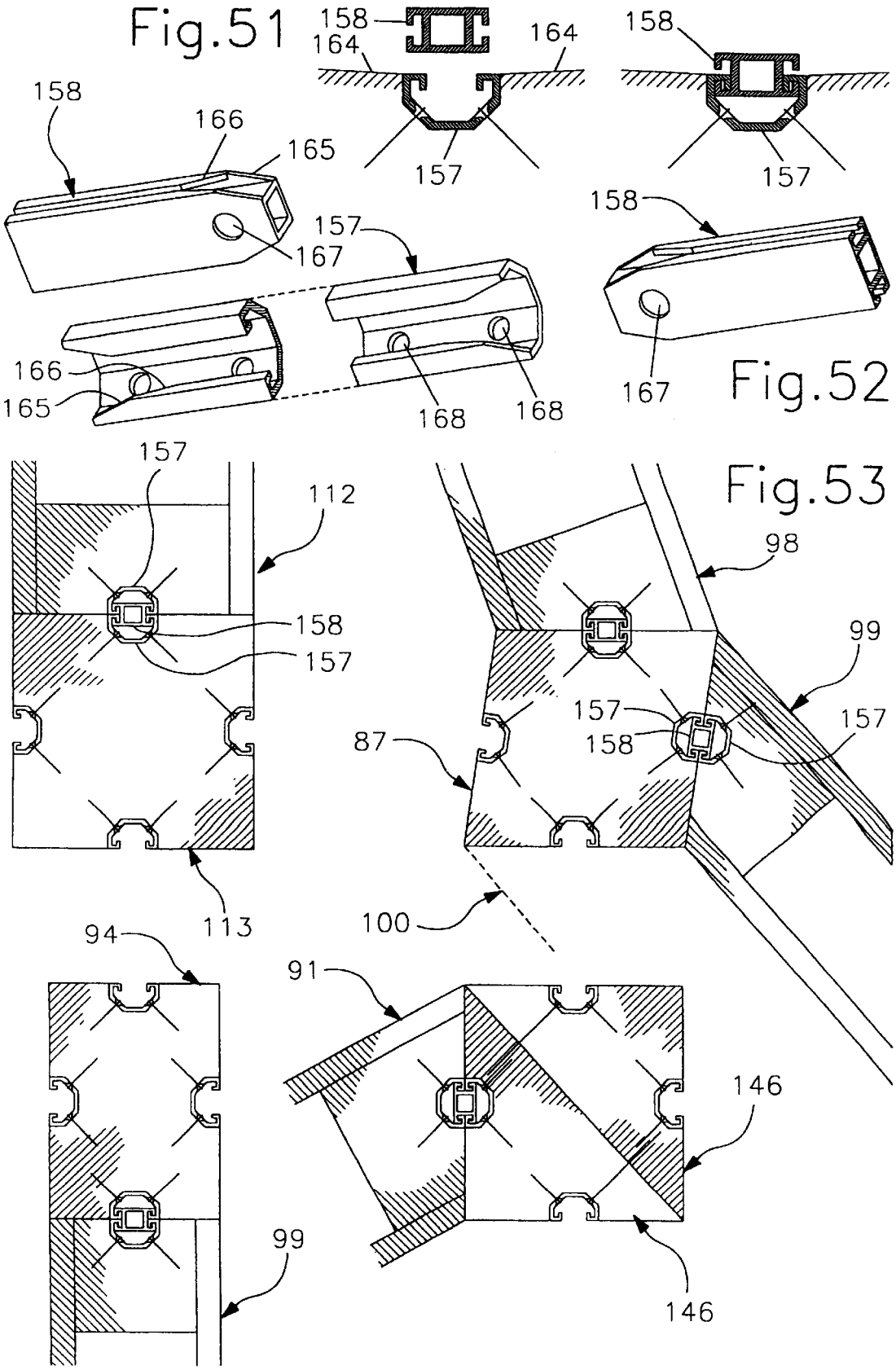
FIG. 51, which shows the connecting profile cross sections of FIG. 49, shown separated and inserted into one another.
FIG. 52, which shows the connecting profiles of FIG. 49.
FIG. 53, which shows some bar cross sections from FIG. 49 with plate junctions.

What is much more important, however, than the connection of bars on their ends is the connection of bars to plates on their sides, to other bars on their sides, and to one another between plates; the rails for this purpose are therefore shown in more detail in FIGS. 51 and 52. The rail 158 in the form of an elongated "H" with multiple serifs, has the function of a clamp. This is being as shown in FIG. 51 in section for the state beforehand and afterward, inserted into the two hollowed-out rails 156 or 157 in the form of a "C", only one of which is shown. The imprecision that exists anyway, or an intentional oblique location of the two partial faces 164 of a concave side face of a component—or of plates—interrupted by the groove, causes a prestress when the H-rail is inserted, which not only makes the connections fairly rigid but also prevents the plates from shifting relative to one another in the longitudinal direction of the side edges in the constructed state, or in the event of large-scale imprecision—on the condition that the plate side faces are suitably rough, and the rail sliding faces are suitably smooth.

To make the plate connection rigid yet allow it to be achieved without effort, the inside clearance at the end of each C-rail is widened, as in FIG. 52, by chamfering the outer flanges in two different directions 165, 166, so that the H-rail can be inserted imprecisely yet is still interlocked exactly and with tension in the two C-rails in the final state. In the same way, an H-rail is chamfered on its ends. So that when the building construction is dismantled the H-rail can be pulled out again from between two components, it is longer than the C-rails and is provided with holes 167 on both ends, so that a tool can be hooked into the holes to pull it out. It is widened into a hollow profile, so that it will not become bent or twisted during the assembly.

The C-rails include holes 168 so that they can be screwed to their component, but also for passing screws through into a second half bar, if two half bars are to be joined together with their diagonal side faces toward one another. The oblique location of the two pierced faces of a C-rail assures that the screws will spread against one another in the same component, and the two holding bars can be screwed together virtually at right angles.

FIG. 53 shows the sections in true proportion through four bars 87, 94, 113, 146 vertically to their primary orientation, two of which bars 146 are identical, in the mode of construction of FIG. 49. To these bars, plates 98, 99, 100, 112 are joined in accordance with the installation situations shown in FIGS. 37 and 47. The two profiles 94, 113 shown on the left in FIG. 53 are rectangular. The equilateral upper, equilateral profile 113 belongs to the walls in FIG. 37. For connection to a plate 112 which in this case is located perpendicularly in space, an H-rail 158 is again inserted between or into the two C-rails 156.

The other three profiles 87, 146, 146 are shown in the right half of FIG. 53 with the junctions of the plates in the relationship shown in FIG. 47. Two plates 98, 99 of different thickness and orientation are joined to the lozenge profile 87 typical of the eightfold geometry. The plate 100 left out in FIG. 47 is represented in section merely by its outer edge in the form of a dashed line. In a distinction from FIGS. 47 and 48, the two half bars 146 of triangular profile are again secured to one another, in order to replace one entire bar 92 of rectangular of the kind installed in FIG. 37.

Bars of rectangular cross section must be "split" wherever large-scale components are not only to be put together beforehand but also, to enable convenient repair, must be capable of being replaced later or removed individually without destroying the overall structure; from the edges of the large-scale component, all the sliding connections must be accessible without major effort, so that individual plates can be removed. The "splitting" of the bars is diagonal, because in the absence of tolerances and with the aforementioned initial tensions, it would be impossible to reinsert large-scale components if the bars forced into place were each split lengthwise in cross section into two half bars parallel to the insertion direction.

The side faces of the plates need not simply be plane, as shown in FIG. 3. In arrangements in which there is at least one bar virtually everywhere between two plates 2, 3, the bars 13, 14 can also be divided, and their space can be utilized for easy assembly from outside, for which a respective piece 169, 170 is attached irreversibly to a corresponding plate 2, 3.

To these pieces 169, 170 is suitably given the profile of a quarter of the bar profile, which extends from two edges as far as the center axis. In FIG. 44, this quartering is shown in advance by triangles on the ends of the bars. Between two plates 171, 172, two additional quarter bars 173, 174 must be inserted as connecting elements.

Figure 55:
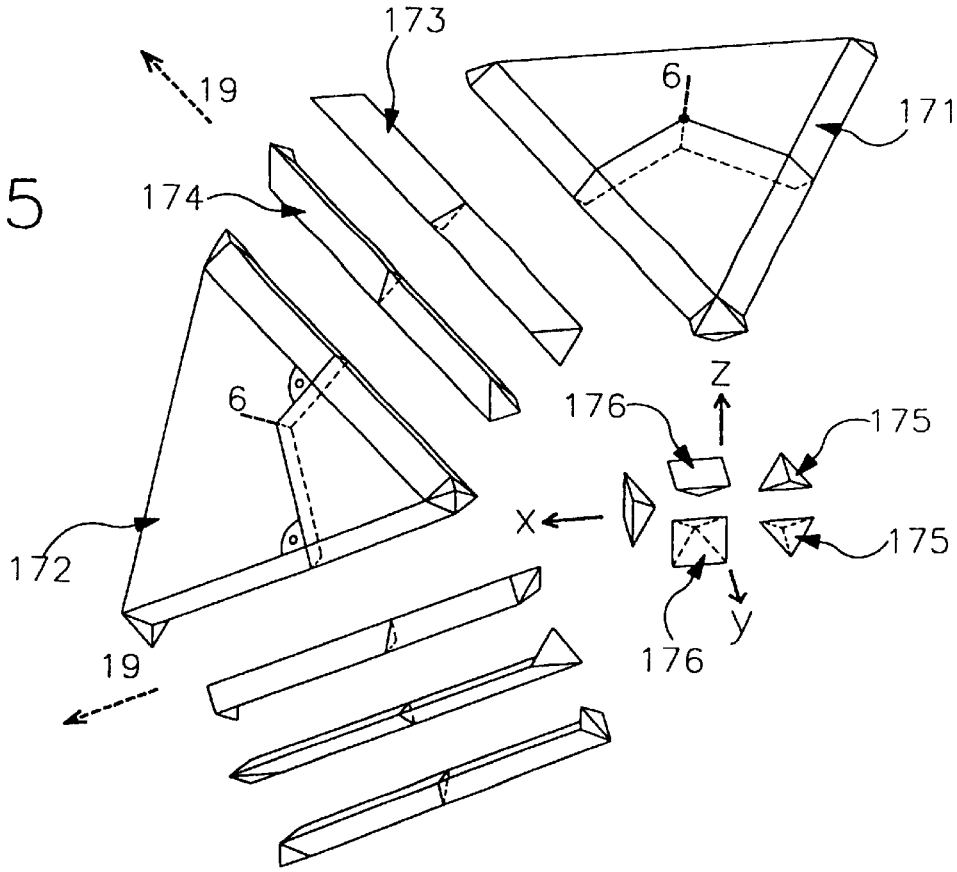
FIG. 55, which shows the components of FIG. 54, disconnected and some of them connected in a new configuration.

FIG. 55 shows the result of the cutting apart of bars, but also of cubes: A cube 16 at the end of the bars has also been split apart through its center point. Segments that contact an end of a quarter bar are attached to this quarter bar. Segments contacting one another from two adjacent cubes are combined into tetrahedrons 175. The other regions in the place of a cube are filled with semi-octahedrons 176.

The connecting elements 173, 174 can each be screwed onto the plates from outside. If their respective primary orientation is parallel to the side faces or to the space diagonal of a cube or in projection onto a plane, which is located parallel to the base 15 of its original square bar, forms an angle of 45° with a space axis, as is the case in FIG. 27, then it is also possible to secure these connecting elements 173, 174 by setting them up on the plate edge and then slightly displacing them along the plate joint, with a few small head bolts engaging oblong slots widened on their ends. The semi-octahedrons 176 then take on the task of joining together the quarter bar ends in such a way that no component can shift relative to another one. If connecting elements in the form of rectilinear prisms are to be capable of later removal, in order to recover enough space to displace them, then the tips must be hinged somewhat (not shown) at the ends of preferably all the connecting elements.

In FIG. 55, after later assembly, the connecting elements 173, 174 adjoin directly by their connecting faces one to another—"cattycorner" from one another, because of the location of the plates. Mostly, however, the two connecting elements face one another or are one above the other at the plate seam. When the sheaf-like interstices are glued above the plate joint with sealing tape, before the one outer or upper connecting element is installed, a later concealed gutter system is then created, in which water that has entered can drain off to the outside. The small hollow space required for this is created by a flattening, not shown, of the outer or upper connecting element longitudinally at its most obtuse edge.

What is claimed is:

1. A building system for assembled, self-supporting and faceted polyhedral shells including zomes, comprising: prefabricated, solid plates as material components, joined along their edges without nodes on their corner points, wherein:

two neighboring, differently inclined plates are joined everywhere by their side faces according to one of: both ways occurring in the same building; directly to one another, if the adjoining side faces are parallel without any distance; and via bars as complementary components along some joints;

each said bar fills completely one of: a cleft along the joint between two plates touching one another only by one edge line; and an oblong gap, necessarily continuing a cleft, between two plates touching one another nowhere;

the adjoining side faces of two plates, of a plate and a bar, and of two bars side by side are congruent everywhere and have the shape of an oblong parallelogram having two shorter and two longer edges;

said plates and bars are in the form of a slanted prism;

said plates are in the form of a flat parallelepiped having an extensive polygonal base defining the top and bottom surface of a plate;

said bars are in the form of a stretched parallelepiped having a small quadratic base defining the ends of a bar;

the quadratic faces on the ends of different bars are equal everywhere;

said two shorter edges of each said parallelogram have the length of said quadratic faces;

said shorter edges are always disposed parallel to the areas of a cartesian coordinate system;

two bars adjoin on one of their ends always according to one of: directly, if said quadratic faces on the ends are parallel without any distance; and via cubes having said quadratic faces too, if there are gaps between the ends of neighboring bars, filling them completely.

2. The building system as defined in claim 1, wherein said components as plates and bars belong to a restricted set of types of a building construction kit, and said two longer edges of the side faces of plates and bars define a uniform length, and wherein said edges projected on two of three projection planes, of which each is parallel to one of said quadratic faces, deviate by an angle of 22.5° from a respective edge of one of said quadratic faces.

3. The building system as defined in claim 1, further comprising oblong connectors, securing a joint, which is rigid against transverse and bending forces by a prestress, wherein:

said connectors are located in the midline of each joint between two adjacent components as plates and bars;

said connectors have the form of a rail being one of:

a rail type C having the uniform cross-sectional profile of a C; and a rail type H having the uniform cross-sectional profile of an H;

one rail of type H is inserted lengthwise into two faced rails C, each rail type C being part of a component and acting as an anchor channel;

each rail type C is inlet into a groove milled along the middle of said side face divided hereby in two partial faces;

each of said side faces has been made concave making said partial faces oblique in cross section and causing a distance between two profiles of type C of two components touching each other merely on the edges of their top and bottom surfaces, but not being connected;

one rail type H connects two components by drawing their facing rails of type C together like a clamp, causing compression on said partial faces;

said prestress consists of a tension between the connected profiles of type C and a pressure between the adjacent ones of said partial faces of adjacent components;

said connectors have serif-like, rectangularly doubled hooks, visible in a cross-section, against forces from different directions;

said connectors have multiple, differently directed conical ends to facilitate the lengthwise telescoping insertion of a rail of type H into the joint.

4. The building system as defined in claim 1, wherein said plates and said bars definitively are deformed on purpose, and wherein the topological arrangement of the components is preserved without misfits.

5. The building system as defined in claim 1, wherein:

said bars are divided diagonally lengthwise into four parts, defining quarter parts, and some of said quarter parts are attached irreversibly by congruent parallel faces to a respective plate, becoming parts of this plate, while each respective remaining one of said quarter parts is used for one of: locking and simultaneously covering the butt between two of said plates, and for covering merely the edge of said plate.

* * * * *

UNITED STATES PATENT AND TRADEMARK OFFICE

CERTIFICATE OF CORRECTION

PATENT NO. : 6,282,849 B1
DATED : September 4, 2001
INVENTOR(S) : Florian Tuczek It is certified that error appears in the above-identified patent and that said Letters Patent is hereby corrected as shown below:

Title page, Item [54] and Column 1, line 1,
The Title should be -- BUILDING SYSTEM --.
Item [76], Inventor, the address should be -- Sebastian-Bach-Strasse 36 D-04109 Leipzig (DE) --.

Column 1,
Line 5, "structural" should be -- building --.
Line 40, -- plates or sheets, and can withstand only slight loads. -- should be inserted after "thin".

Column 2,
Line 51, "through" should be -- thought --.

Column 3,
Line 46, "drawing" should be -- drawings --.

Column 17,
Line 26, "construction" should be -- building --.

Column 18,
Line 22, "equilateral" should be deleted.

Signed and Sealed this

Twenty-sixth Day of November, 2002

*Attest:*

*Attesting Officer*

JAMES E. ROGAN
*Director of the United States Patent and Trademark Office*